United States Patent [19]

Coles

[11] 4,172,434

[45] Oct. 30, 1979

[54] INTERNAL COMBUSTION ENGINE

[76] Inventor: Donald K. Coles, 2505 Capitol Ave., Fort Wayne, Ind. 46806

[21] Appl. No.: 867,544

[22] Filed: Jan. 6, 1978

[51] Int. Cl.[2] ..... F02D 17/00

[52] U.S. Cl. ..... 123/32 EA; 123/198 F

[58] Field of Search ..... 123/198 F, 32 EA, 198 PB, 123/32 EB, 32 EC, 102

[56] References Cited

U.S. PATENT DOCUMENTS

| | | | |
|---|---|---|---|
| 2,771,867 | 11/1956 | Peras | 123/198 F |
| 3,756,205 | 9/1973 | Frost | 123/198 F |
| 4,015,428 | 4/1977 | Kawai | 123/198 F |
| 4,024,850 | 5/1977 | Peter et al. | 123/198 F |
| 4,040,395 | 8/1977 | Demetrescu | 123/198 F |

*Primary Examiner*—Ira S. Lazarus

[57] ABSTRACT

In order to reduce engine output torque, a gasoline engine can omit the ration of fuel from a proportion of its cylinder cycles, employing a pattern of successive inhibition and enablement of its fuel rations. For a given output torque, different patterns of successive enablement and inhibition can be selected to minimize transmission of vibration from the engine to its environment. Selection of the optimum pattern can be made automatically.

4 Claims, 47 Drawing Figures

FIG. 4
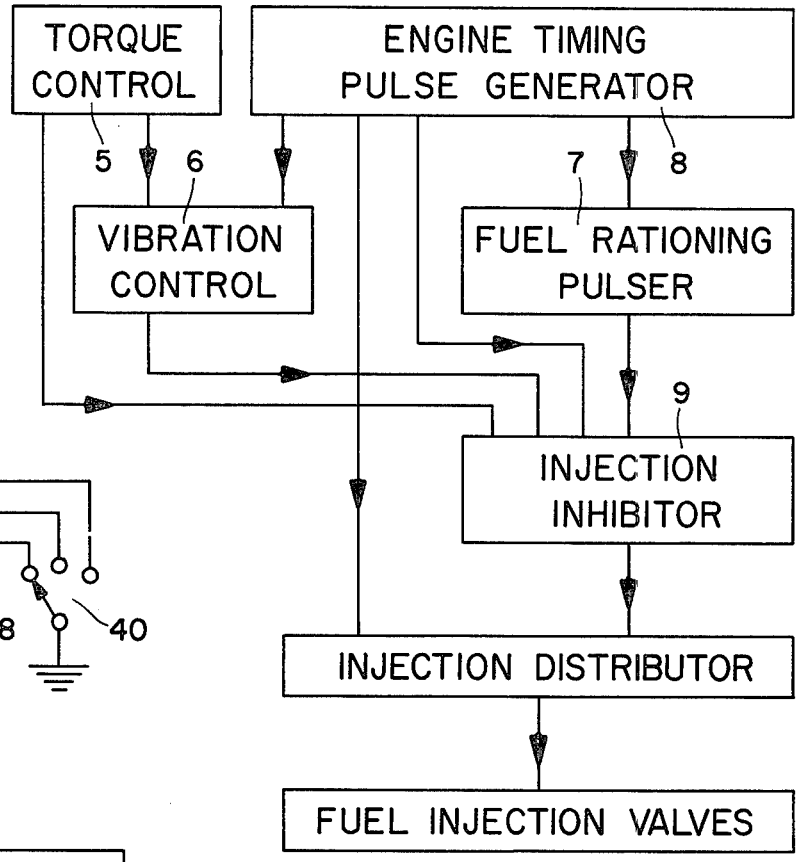
FIG. 5
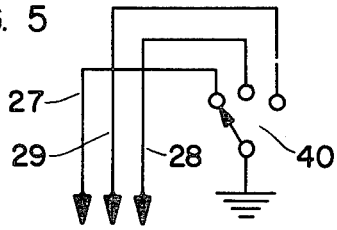
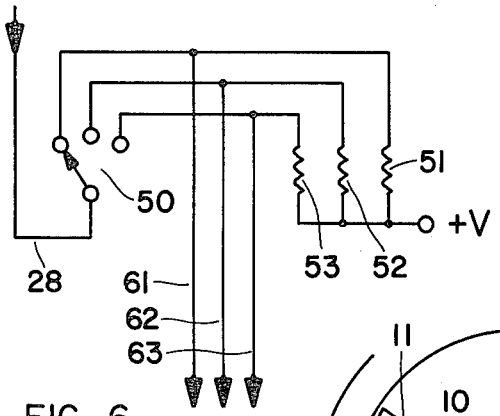
FIG. 6
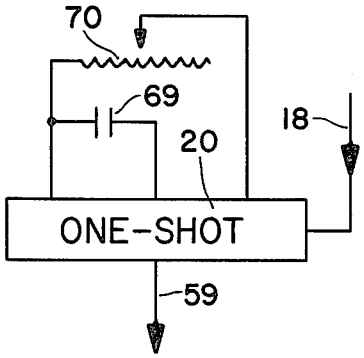
FIG. 7
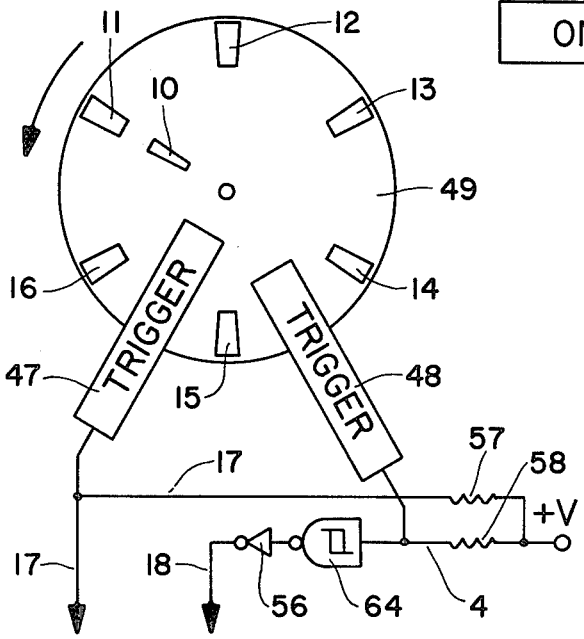
FIG. 8

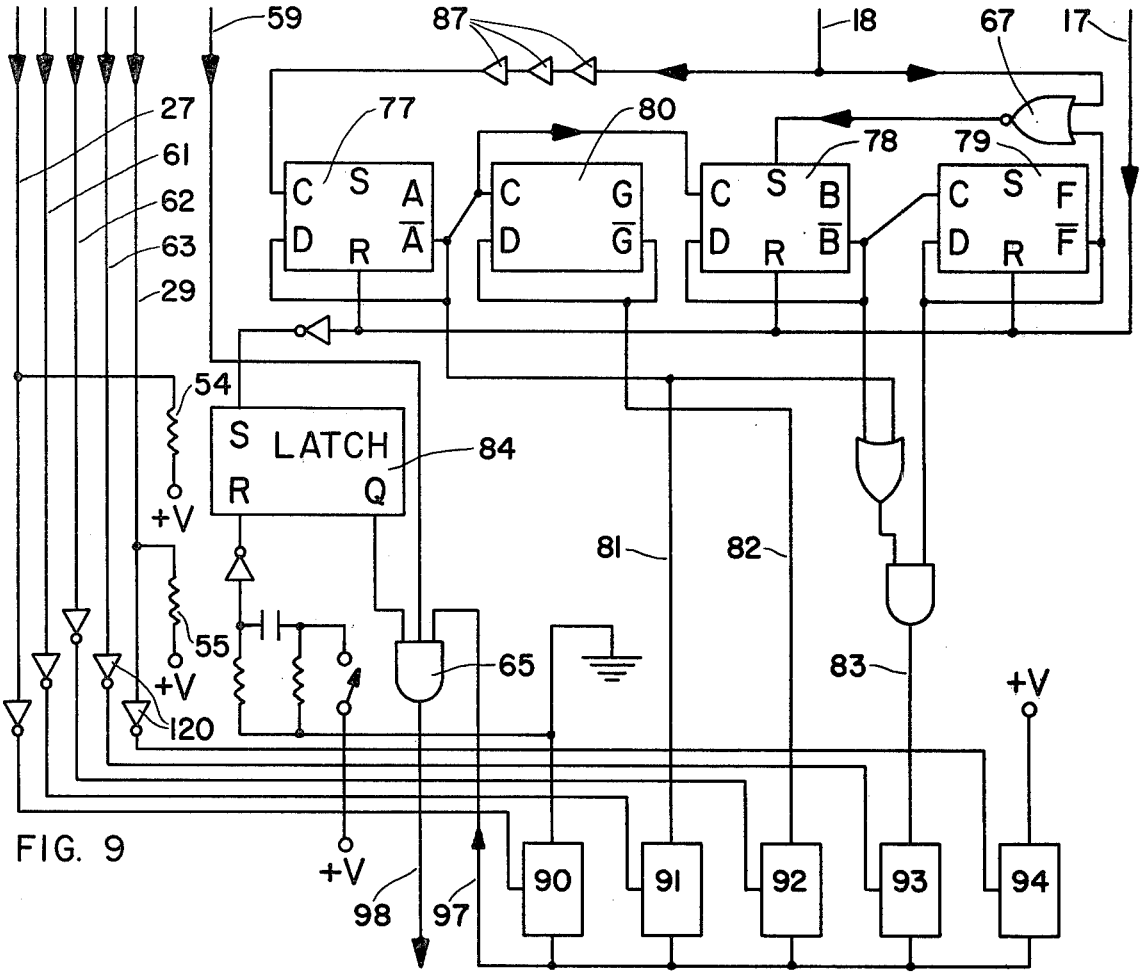
FIG. 9
FIG. 10
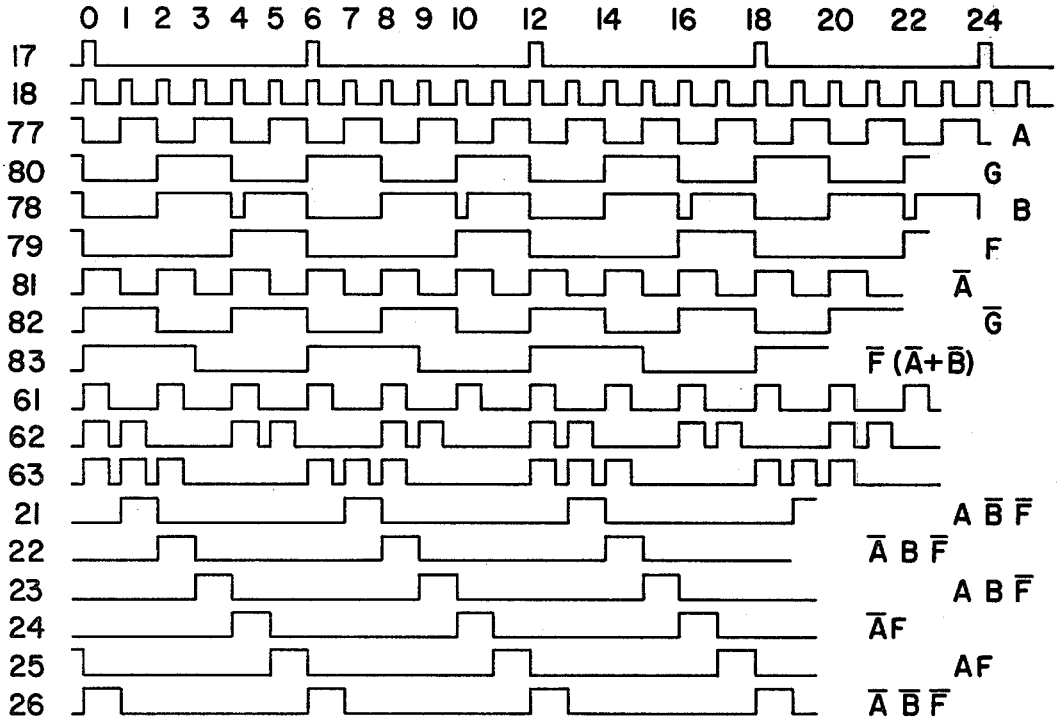

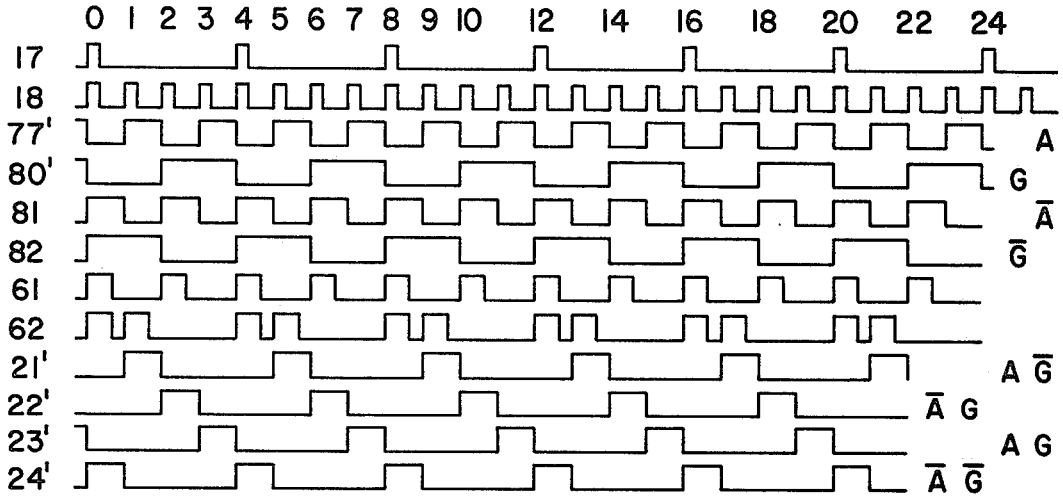
FIG. 30
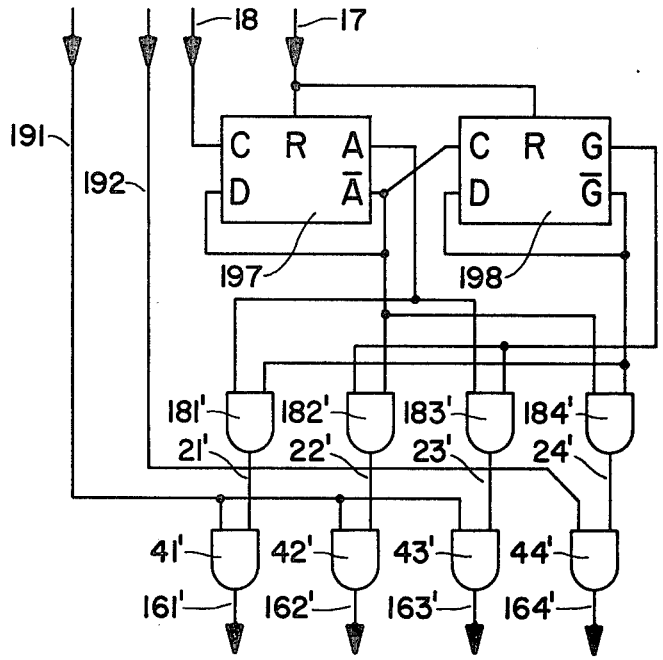
FIG. 31
FIG. 32
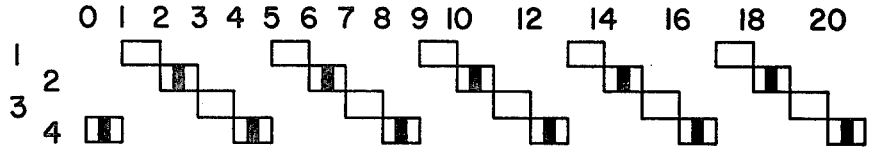
FIG. 33
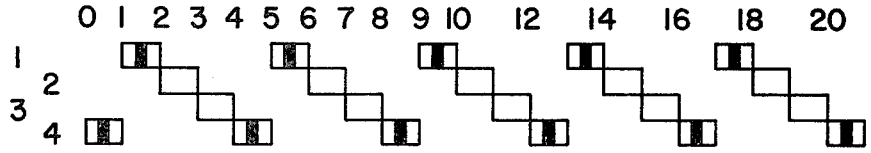

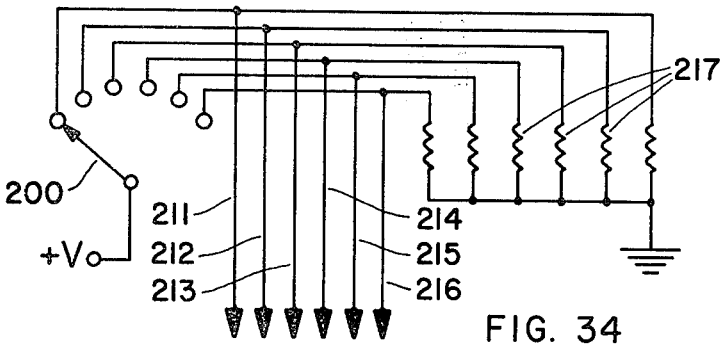
FIG. 34
FIG. 35
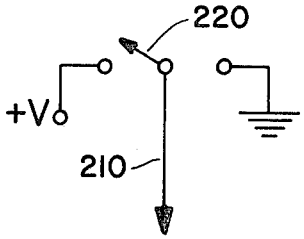
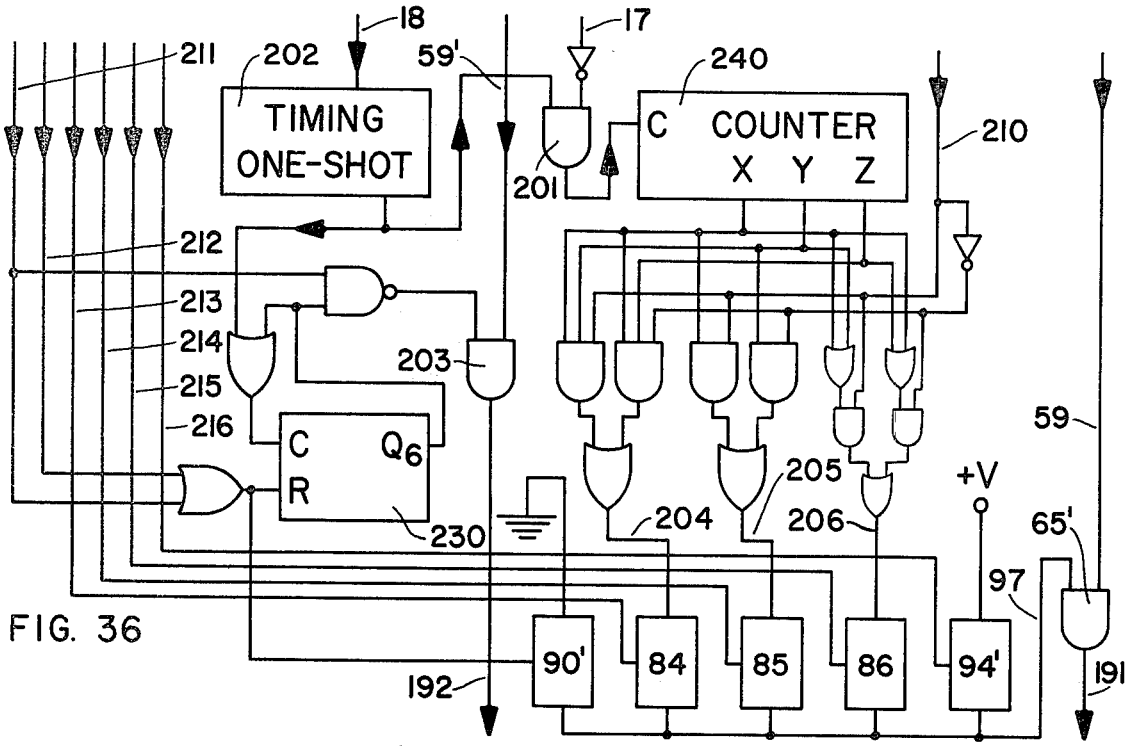
FIG. 36
FIG. 37
| TORQUE CONTROL STATE | TORQUE FRAC-TION | VIBR. CONTROL STATE | BOOL-EAN FORM | ENAB-INHIB. OF ORD. CYL. 0 | 1 | 2 | 3 | 4 | 5 | 6 | 7 |
|---|---|---|---|---|---|---|---|---|---|---|---|
| 1 | 0 | — | 0 | 0 | 0 | 0 | 0 | 0 | 0 | 0 | 0 |
| 2 | .25 | — | 0 | 0 | 0 | 0 | 0 | 0 | 0 | 0 | 0 |
| 3 | .44 | 1 | X Y | 0 | 0 | 0 | 1 | 0 | 0 | 0 | 1 |
| 3 | .44 | 0 | X Z | 0 | 0 | 0 | 0 | 0 | 1 | 0 | 1 |
| 4 | .625 | 1 | X | 0 | 1 | 0 | 1 | 0 | 1 | 0 | 1 |
| 4 | .625 | 0 | Y | 0 | 0 | 1 | 1 | 0 | 0 | 1 | 1 |
| 5 | .81 | 1 | X+Y | 0 | 1 | 1 | 1 | 0 | 1 | 1 | 1 |
| 5 | .81 | 0 | X+Z | 0 | 1 | 0 | 1 | 1 | 1 | 1 | 1 |
| 6 | 1.0 | — | 1 | 1 | 1 | 1 | 1 | 1 | 1 | 1 | 1 |

INTERNAL COMBUSTION ENGINE

BACKGROUND OF THE INVENTION

1. Field of the Invention

An internal combustion engine omits the fuel ration from a fraction of its combustion chamber cycles. The pattern of fuel ration inhibition is selected primarily to control the average engine output torque, and secondarily to control transmission of vibration from the engine to its environment.

2. Prior Art

Gasoline engines generally require some means of controlling their output torque, since the maximum available torque is not always wanted. The traditional method of controlling output torque is to throttle the air intake so that the engine operates at a reduced air pressure. The air intake pressure is then sensed and used in adjusting the ration of fuel for each cylinder cycle so that the fuel-air ratio is near its optimum value. Exact timing of spark ignition is also made to depend on the air intake pressure.

The air intake pressure affects many engine characteristics such as the amount of fuel needed, vaporization and mixing of the fuel with the air, charge stratification, charge ignition, rate of burning, detonation, heat transport to the wall, deposition of carbon, exhaust gas pressure, exhaust gas recirculation, piston blowby, crankcase ventilation, and atmospheric pollution. Thus a gasoline engine's performance is necessarily compromised if it must operate over a wide range of air pressure.

Methods of engine torque control which eliminate the need to heavily throttle the air intake are disclosed in U.S. Pat. Nos. 2,771,867, 2,875,742, 2,878,798, 2,919,686, 3,100,478, 3,181,520, 3,756,205, 4,103,655 and 4,040,395. These methods reduce engine output torque by inhibiting the ration of fuel in a fraction of the combustion chamber cycles. All of the engines in these eight disclosures use fuel injector valves. In the engines of the last disclosures, the valves are electrically operated and the fraction of fuel rations which is skipped is varied through the intervention of an electronic fuel injection inhibitor.

When the engine must be operated with an output torque well below its maximum possible value, the injection inhibitor can be set for partial output torque. Then heavy air throttling is not needed and the throttle can be kept near the point of peak engine efficiency.

Inhibited fuel injection in these engines tends to prolong the life of the exhaust valves and the exhaust pipe. Moreover, cylinder cycles with inhibited fuel injection tend to either oxidize or cool any hot carbon deposits within the cylinder, thus discouraging preignition. This action is particularly effective at low torque levels that tend to develop carbon deposits in conventional engines.

In engines with carburetors, fractional inhibition of fuel rations can be implemented by cutting off the air-fuel mixture to particular predetermined cylinders. Many engines using the principle have been built. Engines of this type are disclosed in U.S. Pat. Nos. 2,250,814 and 4,018,204 and in *Popular Science,* January 1977, page 70–72.

A difficulty with all of these engines having inhibited fuel rations is the uneven generation of power. This difficulty can be alleviated by using a rather heavy flywheel. Another difficulty is that these engines tend to vibrate excessively at low engine speeds.

If an internal combustion engine is not bolted down to a massive foundation, it tends to vibrate and to transmit its vibration to the environment. The forces producing vibration are classified as either gas forces or inertia forces. Of these, the inertia forces tend to increase in proportion to the square of the engine speed, and to be unaffected by fuel ration inhibition per se. The gas forces are approximately balanced, but they result in an uneven engine output torque, whose reaction on the engine tends to make the engine rock about an axis roughly parallel to the crankshaft axis. This engine rocking torque tends to be independent of engine speed, so that engine rock due to gas forces dominates at low engine speeds.

In order to reduce transmission of engine vibration to the environment, the engine is commonly mounted on a resilient support allowing it to rock, with a restoring couple giving it a natural rocking frequency lower than most engine frequencies. This arrangement works well at the higher engine speeds, but it may do more harm than good at a low engine speed for which a gas torque frequency coincides with the natural engine rocking frequency.

When an engine has a fraction of its fuel rations inhibited, the reduction of its average output torque is accompanied by an increase in some of its low frequency torque components. Thus at low engine speeds a considerable amount of mechanical vibration may be transmitted from an inhibited engine to its environment. If there is a flexible drive train between the engine and its load, excessive oscillation may develop in this drive train, especially at low engine speeds.

SUMMARY OF THE INVENTION

In order to prevent transmission of vibration from my inhibited engine to its environment, the engine is mounted in a resilient support. The object of my invention is to limit vibration of the engine in its resilient mount by timing the enabled fuel rations so that their vibratory effects tend to cancel, rather than add. The optimum pattern of enabled and inhibited fuel rations depends on the engine speed in relation to the natural frequency of the engine in its resilient support.

The preferred embodiment is a six cylinder engine which can have the fuel ration inhibited in one half of its cylinder cycles. When operating in this way at half of full output torque, the vibration control allows selection between at least two different patterns of fuel ration enablement and inhibition. The first pattern has enabled cylinder cycles spaced evenly by 240 degrees of crankshaft travel. The second pattern has enabled cylinder cycles spaced alternately by 120 degrees and 360 degrees of crankshaft travel.

In another embodiment, selection between the two patterns is made automatically in dependence on engine speed. The vibration control can also be used to avoid excessive oscillations in the power train between the engine and its load.

BRIEF DESCRIPTION OF THE DRAWINGS

FIG. 4 is a block diagram of my inhibited engine control.

FIG. 5 shows the torque control for the preferred embodiment of my invention.

FIG. 6 shows the vibration control for the preferred embodiment.

FIG. 7 shows the fuel rationing pulser.

FIG. 8 shows the engine timing pulse generator.

FIG. 9 shows the fuel injection inhibitor.

FIG. 10 shows timing patterns of enabled and inhibited fuel rations.

FIG. 30 shows timing patterns of enabled and inhibited fuel rations for the third embodiment.

FIG. 31 shows the injection distributor for the four cylinder engine.

FIGS. 32, 33 show distribution of enabled and inhibited cycles among the cylinders for the third embodiment.

FIG. 34 shows the torque control for the fourth embodiment.

FIG. 35 shows the vibration control for the fourth embodiment.

FIG. 36 shows the injection inhibitor for the fourth embodiment.

FIG. 37 tabulates the patterns of enabled and inhibited fuel rations for the fourth embodiment.

DESCRIPTION OF THE PREFERRED EMBODIMENT

My engine has six combustion chambers, each defined by a cylinder with a fixed closure at one end and a movable piston at the other end. Each cylinder has an electrically actuated fuel injector valve. The valve is positioned to spray gasoline into the cylinder past its air inlet valve, while it is open, during the air inlet stroke. The mixture of air and fuel in each cylinder is compressed by the piston and it is ignited by means of an electric spark near the end of the compression stroke. The fuel supply system is shown in FIG. 1.

Figure 1:
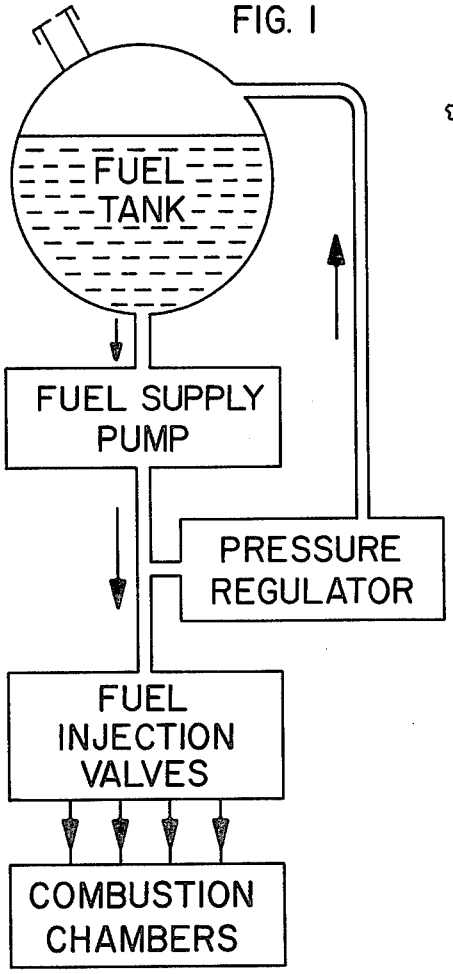
FIG. 1 shows the fuel supply system for my engine.

Referring to FIG. 1, a liquid fuel such as gasoline is stored in the bottom part of the fuel tank. The top part of the fuel tank communicates with the atmosphere. Gasoline is drawn from the bottom of the fuel tank by an electrical fuel supply pump of fixed displacement. The gasoline is forced into a fuel line and through the six fuel injection valves into the cylinders. Fuel pumped from the fuel tank in excess of engine requirement is returned through a pressure regulator to the fuel tank. The absolute pressure in the fuel line is adjusted to be several times the external atmospheric pressure.

Figure 2:
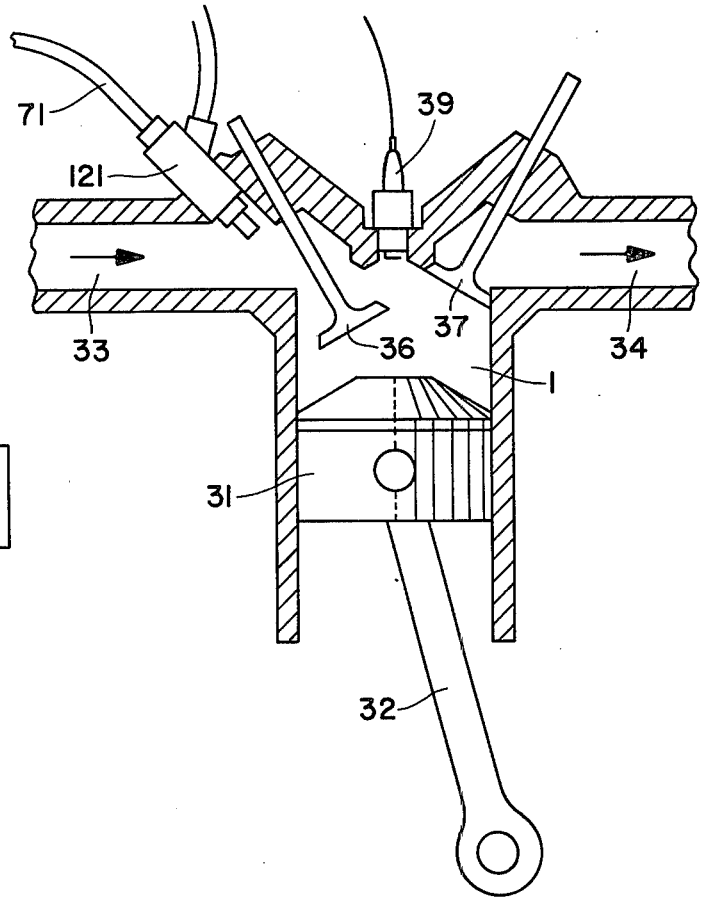
FIG. 2 shows a combustion chamber.

One of the combustion chambers is shown in FIG. 2. Movable piston 31 slides in cylinder 1. The piston is connected to one end of connecting rod 32. Air enters through inlet duct 33; exhaust gases are discharged through exhaust duct 34. Air inlet valve 36 is shown open, exhaust valve 37 is shown closed. Fuel injector valve 121 is mounted in inlet duct 33. This fuel injector valve receives liquid gasoline under pressure from fuel line 71, and sprays it past the open air inlet valve.

The electrically actuated fuel injector valve is normally closed. It is opened, and held open long enough to deliver a fuel ration, by precise electronic gating. The air fuel mixture is then compressed by the piston, and ignited by a spark at spark plug 39.

The six cylinders are in a line, being connected to a common crankshaft (not shown). A flywheel is mounted on one end of the crankshaft and rotates with it. When the engine is operated at full power, the power strokes in different cylinders are evenly spaced, the spacing being 120 degrees of crankshaft travel.

The crankshaft is symmetrical about a central plane perpendicular to its axis; primary and secondary inertia forces in the engine are balanced. The main unbalanced torque, due to gas forces, tends to rock the engine about an axis parallel to the axis of the crankshaft. The mass of the engine is distributed so that a principal axis of inertia is parallel to this axis of the crankshaft.

In order to prevent transmission of vibration from the engine to its environment, the engine is mounted so that it can rock about a rocking axis coinciding with the principal axis of inertia. The rocking motion is opposed by a spring couple which gives a natural vibration frequency of about fifteen cycles per second. The rocking motion is lightly damped by internal friction in the spring material. The crankshaft is coupled through a fluid clutch and gearing to a power output shaft located on the engine rocking axis, the output shaft being coupled to the load through a drive shaft with a universal joint on each end.

When the engine is operating at full speed, the torque pulses due to gas forces have only a short time to operate, so that they produce an engine vibration of very low amplitude. At low engine speeds, however, the torque pulses have a longer time to operate, so that they tend to produce an extensive rocking motion of the engine. This rocking motion tends to be increased by inhibition of fuel rations in a fraction of the cylinder cycles.

The crankshaft is geared to a camshaft and to an electrical timing shaft, both of which rotate at one half crankshaft speed. The camshaft actuates the air inlet and exhaust valves for the six cylinders. The electrical timing shaft provides timing for spark ignition and for electronic fuel injection.

A block diagram of electronic apparatus for controlling fuel injection is shown in FIG. 4. Referring to FIG. 4, an ENGINE TIMING PULSE GENERATOR triggers a FUEL RATIONING PULSER which supplies rationing pulses to the solenoids of the FUEL INJECTION VALVES. The size of the fuel ration in each cylinder cycle is determined by the duration of the rationing pulses. The pulse can be either enabled or inhibited by the INJECTION INHIBITOR, which responds to the TORQUE CONTROL and the VIBRATION CONTROL. The fuel ration is directed to the proper cylinder by the INJECTION DISTRIBUTOR, which receives timing pulses from the ENGINE TIMING PULSE GENERATOR 8. These units will be described subsequently. The TIMING PULSE GENERATOR 8 is shown in FIG. 8.

Referring to FIG. 8, injection timing disk 49, rotating with the electrical timing shaft, carries six slots 11–16 near its edge, the slots being spaced at 60 degrees from each other. Trigger 48 senses the passing of each of these slots. A seventh slot 10, aligned with slot 11, is closer to the center of the timing disk. Trigger 47 is spaced about 63 degrees ahead of trigger 48, so that trigger 47 senses slot 10 slightly before trigger 48 senses slot 16.

Output leads 17, 4, from triggers 47, 48, are normally grounded by the triggers, but during the instant that a slot passes one of the triggers its output is open-circulated. This action allows the trigger output to be pulled up to the upper power supply potential (which may be 8 to 12 volts) by means of pullup resistor 57 or 58 (one kilohm). When one of the slots 11–16 passes trigger 48, its positive output pulse is sharpened by Schmitt trigger 64 and buffer 56, then transmitted on lead 18 to the FUEL RATIONING PULSER.

The size of the fuel ration is adjustable, depending on the air inlet pressure. For this purpose, the rationing pulser has an adjustable timing element which determines the duration of its output pulse, as shown in FIG. 7. Referring to FIG. 7, the input pulse on lead 18 triggers one-shot 20, which is connected to variable resistor 70, having a maximum resistance of a megohm. For a given air intake pressure, the resistance is adjusted for good fuel economy and low atmospheric pollution. Capacitor 69 is 0.1 microfarad.

Within a particular cylinder cycle, a cylinder does not receive a partial ration: it either receives a fuel ration adequate for combining with the amount of air inducted into the cylinder, or else it receives no fuel ration at all in that cylinder cycle.

The output from the fuel rationing pulser can be inhibited by the INJECTION INHIBITOR. The inhibitor receives its control signals from the TORQUE CONTROL and the VIBRATION CONTROL.

A diagram of the manually operated torque control is shown in FIG. 5. Referring to FIG. 5, three-position rotary switch 40 has its rotor contact grounded; the output leads are pulled toward the upper power supply potential by pullup resistors in the vibration control and the injection inhibitor. When the switch is in its first position, lead 27 is grounded. This action inhibits the fuel ration in all of the cylinder cycles, thus reducing the engine output torque to zero.

When the switch is in its second position, lead 28 is grounded. This action inhibits the fuel ration in one half of the cylinder cycles, thus reducing the average engine output torque to one half of full torque.

In speaking of average engine output torque, the torque is taken to be the average work done by the explosion of air-fuel mixture per radian of crankshaft revolution. Thus, for a particular throttle setting, the fraction of full output torque which is developed is equal to the fraction of total cylinder cycles with enabled fuel injection.

The VIBRATION CONTROL does not affect the average engine output torque, because it does not change the fraction of total cylinder cycles that have enabled fuel rations. The vibration control is diagramed in FIG. 6.

Referring to FIG. 6, output leads 61, 62, 63 are normally pulled toward the upper power supply potential by pullup resistors 51, 52, 53 respectively. Grounding of input lead 28 by the torque control switch makes rotary switch 50 effective. When the vibration control switch is in its first position, output lead 61 is grounded. When switch 50 is in its second position, lead 62 is grounded. When switch 50 is in its last position, lead 63 is grounded. Leads 61, 62, 63 run to the fuel injection inhibitor.

Referring again to FIG. 4, the rationing output pulse from the RATIONING PULSER is intercepted by the INJECTION INHIBITOR, which may either enable or inhibit the pulse. If the pulse is enabled, it proceeds through the INJECTION DISTRIBUTOR to the FUEL INJECTION VALVE in the appropriate cylinder. The fuel injection valves and the injection distributor will be described later. A particular pattern of successive enablement and inhibition of fuel rations is selected by a steady DC signal sent to the INJECTION INHIBITOR from the VIBRATION CONTROL. A diagram of the INHIBITOR is shown in FIG. 9.

Referring to FIG. 9, a positive pulse from the rationing pulser enters on lead 59 and proceeds to AND gate 65, which is enabled or inhibited by a signal on busbar 97. The output from AND gate 65, on lead 98, proceeds to the injection distributor. Timing pulses from trigger 48 enter on lead 18, are delayed slightly by buffers 87, then proceed to the clock input of flip-flop 77. Flip-flops 77 and 80 together constitute a divide-by-four counter, while flip-flops 77, 78, 79 constitute a divide-by-six counter. A synchronizing pulse entering on lead 17 ensures that both counters are reset to zero immediately after timing slot 16 passes trigger 48. Outputs from these counters proceed through electronic switches 91, 92, 93 to busbar 97, where they either enable or inhibit AND gate 65.

Input leads 27 and 29 are pulled toward the upper power supply potential by pullup resistors 54 and 55. When lead 27 is grounded by the torque control, electronic switch 90 is opened so that busbar 97 is connected to ground. This inhibits AND gate 65 steadily, producing zero engine output torque.

When lead 29 is grounded by the torque control, electronic switch 94 is opened so that busbar 97 is connected to the upper power supply potential. This enables AND gate 65 steadily, producing full engine output torque. Of leads 27, 29, 61, 62, 63, only one at a time can be held low, the other four are pulled high. Thus only one of electronic switches 90–94 will be open at a time. Grounding of leads 61, 62, 63 will produce one of three different patterns of successive enablement and inhibition, as illustrated in FIG. 10.

Referring to FIG. 10, the first line shows the synchronizing pulses transmitted from the trigger 47 on lead 17. There is one of these pulses for each revolution of the timing shaft. The second line of FIG. 10, labeled 18, shows timing pulses transmitted from trigger 48 on lead 18. There are six of these pulses for each revolution of the timing shaft.

The next four lines show the true outputs, labeled A, G, B, F, from the four flip-flops 77, 80, 78, 79.

The three lines labeled 81, 82, 83 show the patterns of successive enabling and inhibiting signals on leads 81, 82, 83, shown in FIG. 9. At the end of each train of pulses is shown a Boolean algebraic form specifying the connection of the lead with the complementary outputs of the inhibitor counters. When lead 61 is grounded, switch 91 is opened, so that the signal on lead 81 is transmitted to AND gate 65. When lead 62 is grounded, switch 92 is opened, so that the signal on lead 82 is transmitted to gate 65. When lead 63 is grounded, switch 93 is opened, so the signal on lead 83 is transmitted to AND gate 65. Thus the vibration control switch selects one of three repetitive patterns of successive enablement and inhibition of cylinder cycles.

The rationing pulse from the rationing one-shot is always shorter than the time between timing pulses on lead 18. FIG. 10 shows, on the three lines labeled 61, 62, 63, the three patterns of enabled rationing signals which produce an engine output torque equal to one half of full torque.

Figure 11:
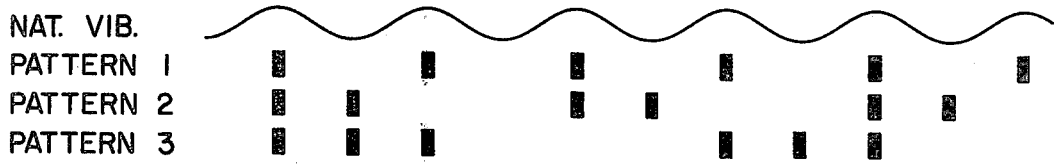
FIGS. 11, 12, 13 show the relationships of the patterns of enabled fuel rations with respect to the natural vibration of the engine in its mount.
Figure 12:
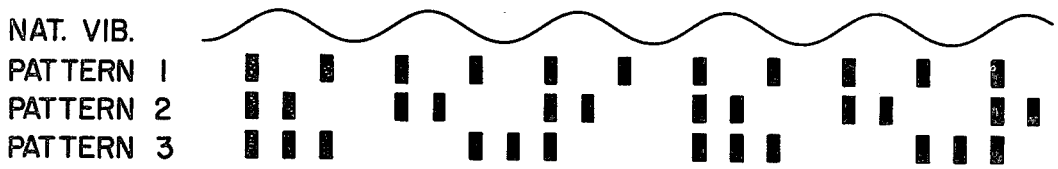
Figure 13:
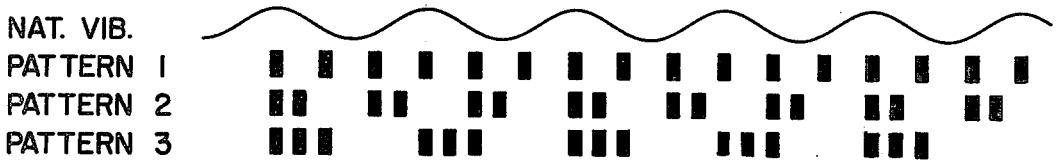

The relationship between the three patterns of enabled rationing signals and the period of vibration of the engine is illustrated in FIGS. 11, 12, 13 for engine speeds of 600, 1200, and 1800 RPM respectively. In each of these figures, the sinusoidal line indicates the natural period of vibration of the engine in its mount. The next three lines show patterns 1, 2, 3 of fuel injection corresponding to positions 1, 2, 3 of the vibration control switch.

Referring to FIG. 11 (for an engine speed of 600 RPM), the period of repetition of pattern 1 is equal to the natural period of vibration of the engine in its mount.

Referring to FIG. 12, for an engine speed of 1200 RPM, the period of repetition of the fuel injections corresponding to pattern 2 is equal to the natural period of vibration of the engine in its mount.

Referring to FIG. 13, for an engine speed of 1800 RPM, the period of repetition of the fuel injections corresponding to pattern 3 is equal to the natural period of vibration of the engine in its mount.

The ratio of the natural period of vibration to the periods of repetition of the patterns of fuel injections is shown in Table 1.

Table 1

| Speed (RPM) | Pattern 1 | Pattern 2 | Pattern 3 |
|---|---|---|---|
| 2400 | 4 | 2 | 1.33 |
| 1800 | 3 | 1.5 | 1.00 |
| 1200 | 2 | 1 | 0.67 |
| 600 | 1 | 0.5 | 0.33 |
| 300 | 0.5 | 0.25 | 0.17 |

In Table 1, the first column gives the crankshaft speed in revolutions per minute. The heading of the table gives the settings of the vibration control. The body of the table gives the ratio of the natural period of engine vibration to the period of repetition of the fuel injection pattern, considering all cylinders to be equivalent. Whenever this ratio is unity, the engine vibration tends to maximize, as illustrated in FIG. 14.

Figure 14:
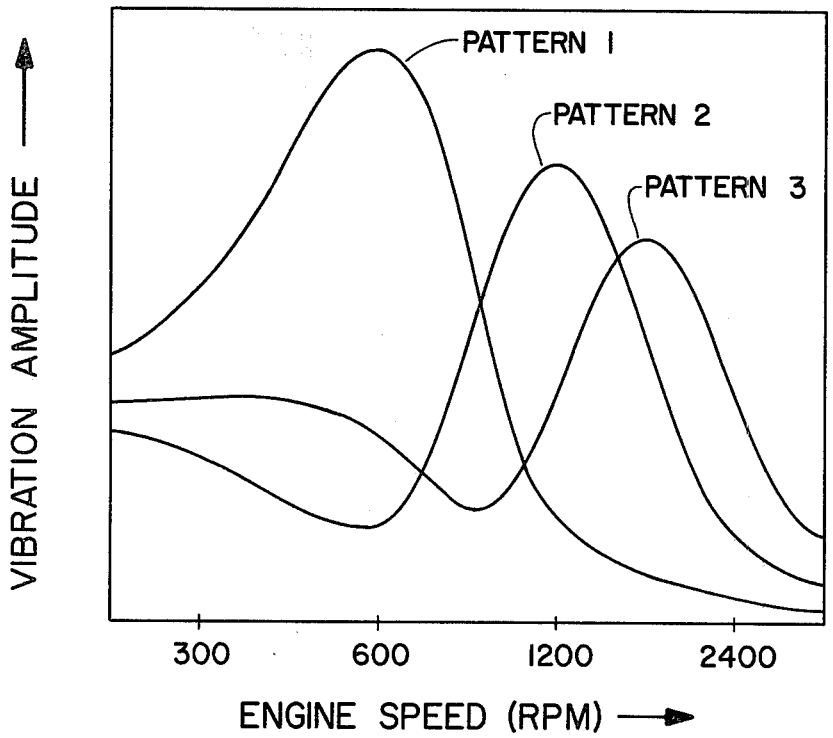
FIG. 14 shows the amplitude of engine vibration as a function of engine speed.

Referring to FIG. 14, the amplitude of engine vibration is shown as a function of engine speed for the three patterns of enabled and inhibited fuel rations, the natural frequency of vibration of the engine in its mount being fifteen cycles per second. When the vibration control switch is set to give pattern 1, engine vibration peaks at 600 RPM, with one explosion per natural vibration period of 360 degrees. At this engine speed, vibration is reduced if the vibration control is changed to give pattern 2, which provides explosions 180 degrees out of phase with respect to the engine vibration.

When the vibration control switch is in position 2, engine vibration peaks at a speed of 1200 RPM, with two explosions per natural vibration, spaced 90 degrees apart with respect to the engine vibration. At this engine speed, vibration is much reduced if the vibration control switch is moved to position 1 so that the two explosions are 180 degrees out of phase with respect to the engine vibration.

In order to minimize engine vibration, the vibration control switch should be kept in position 2 for engine speeds below about 800 RPM, then moved to position 3 or 1 for higher engine speeds. By this means, excessive engine vibration can be avoided at all engine speeds.

In order to prevent fuel from being injected into the engine when the electric power is first turned on, AND gate 65 of FIG. 9 is at first disabled by means of a low output from latch 84. As soon as trigger 47 is activated, a signal on lead 17 sets latch 84, so that AND gate 65 is enabled. The output of AND gate 65 on lead 98 proceeds to the injection distributor, which is diagramed in FIG. 15.

Figure 15:
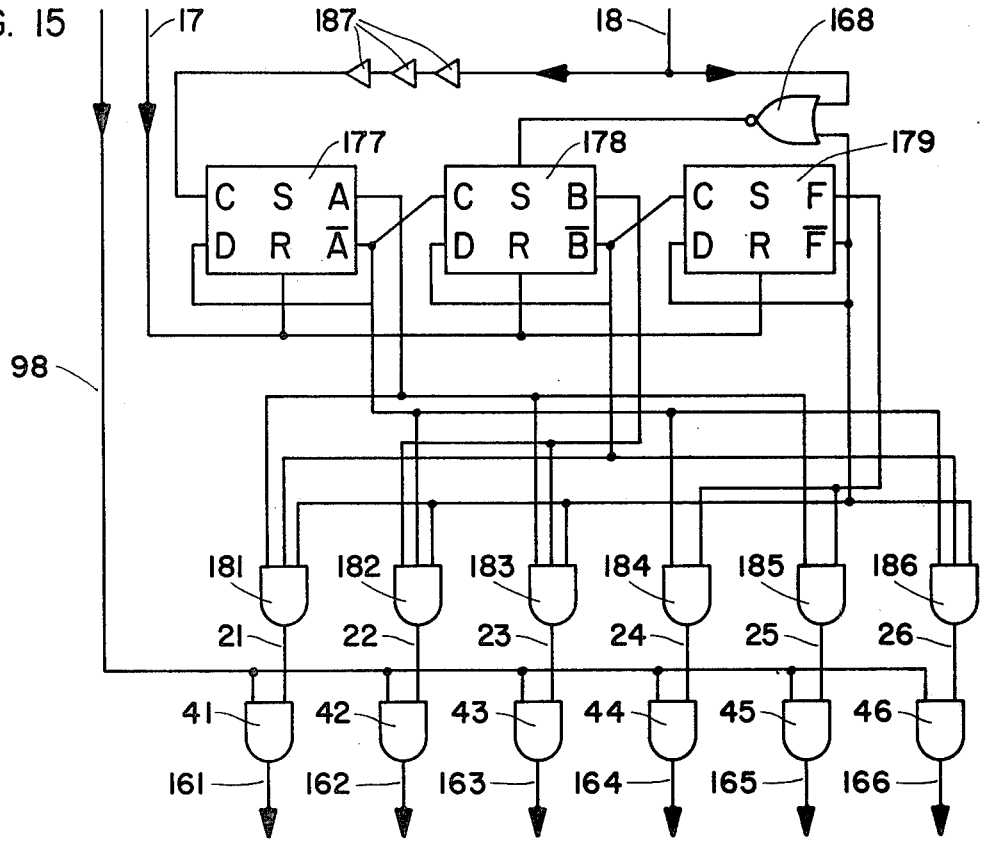
FIG. 15 diagrams the fuel injection distributor.

Referring to FIG. 15, timing pulses from trigger 48 enter on lead 18, are delayed slightly by buffers 187, then proceed to the clock input of flip-flop 177. Flip-flops 177, 178, 179 together constitute a divide-by-six counter. A synchronizing pulse entering on lead 17 ensures that the counter is reset to zero immediately after timing slot 16 passes trigger 48. At the count of zero, the fuel ration is directed to cylinder no 6. At counts 1–5 on the counter, the fuel rationing pulse is directed to cylinders no. 1–5 respectively. The cylinders are numbered according to their firing order when the engine is operating at full engine torque.

The outputs A, B, F from flip-flops 177, 178, 179 are decoded by AND gates 181–186 and distributed on leads 21–26 to AND gates 41–46. The enabling or inhibiting signal on lead 98 from the injection inhibitor is also conducted to AND gates 41–46. The outputs from AND gates 41–46 are transmitted on leads 161–166 to six power amplifiers which drive the six fuel injector valves. The last six lines of FIG. 10 show the distributing signals on leads 21–26. At the end of each train of pulses is shown a Boolean algebraic form specifying the gated connection between the output lead and the true or complementary outputs from the distributor counter.

Figure 16:
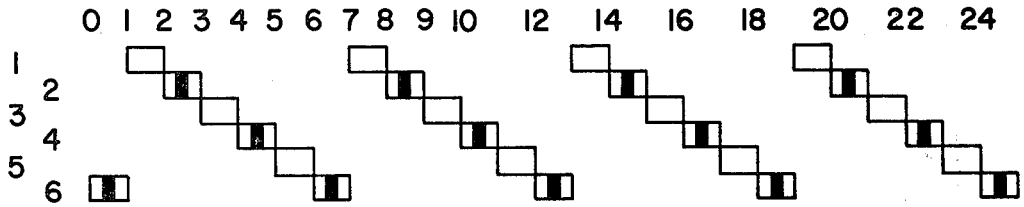
FIGS. 16, 17, 18 show distribution of enabled and inhibited cycles among the engine cylinders.
Figure 17:
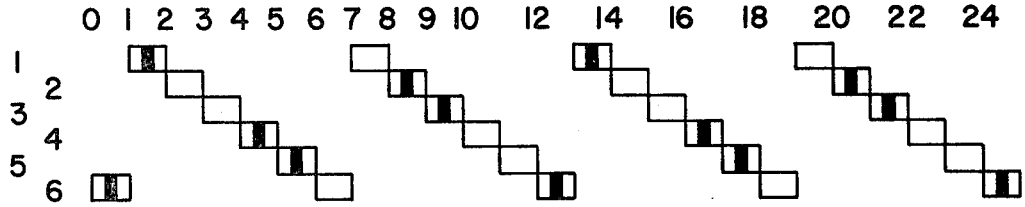
Figure 18:
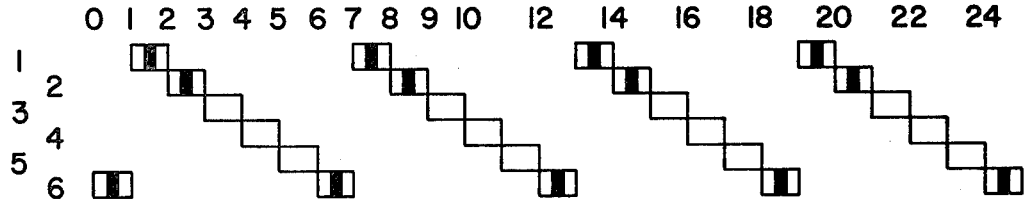

Distribution of fuel rations among the six cylinders is shown in FIGS. 16, 17, 18 for the three different injection patterns diagramed in FIGS. 10–13. In FIGS. 16–18, injections into cylinders 1, 2, 3, 4, 5, 6 are shown on six different levels as labeled. Each cylinder cycle without a fuel ration is shown as a blank rectangle; each cylinder cycle having a fuel ration is shown as a rectangle with a black insert.

Enablement and inhibition pattern no. 1, shown in FIG. 16, has fuel rations enabled in cylinders 2, 4, 6 and inhibited in cylinders 1, 3, 5. Every cycle of cylinders 2, 4, or 6 has its fuel ration enabled. Every cycle of cylinders 1, 3 or 5 has its fuel ration inhibited. Enablement and inhibition pattern no. 3, shown in FIG. 18, has fuel rations enabled in cylinders 1, 2, 6 and inhibited in cylinders 3, 4, 5.

On the other hand, in pattern no. 2, shown in FIG. 17, enabled cylinder cycles are distributed equally among all six cylinders. In each cylinder, cycles with enabled fuel rations alternate with cycles having their fuel rations inhibited. The six fuel injector valves, together with their drivers, are shown in FIG. 3.

Figure 3:
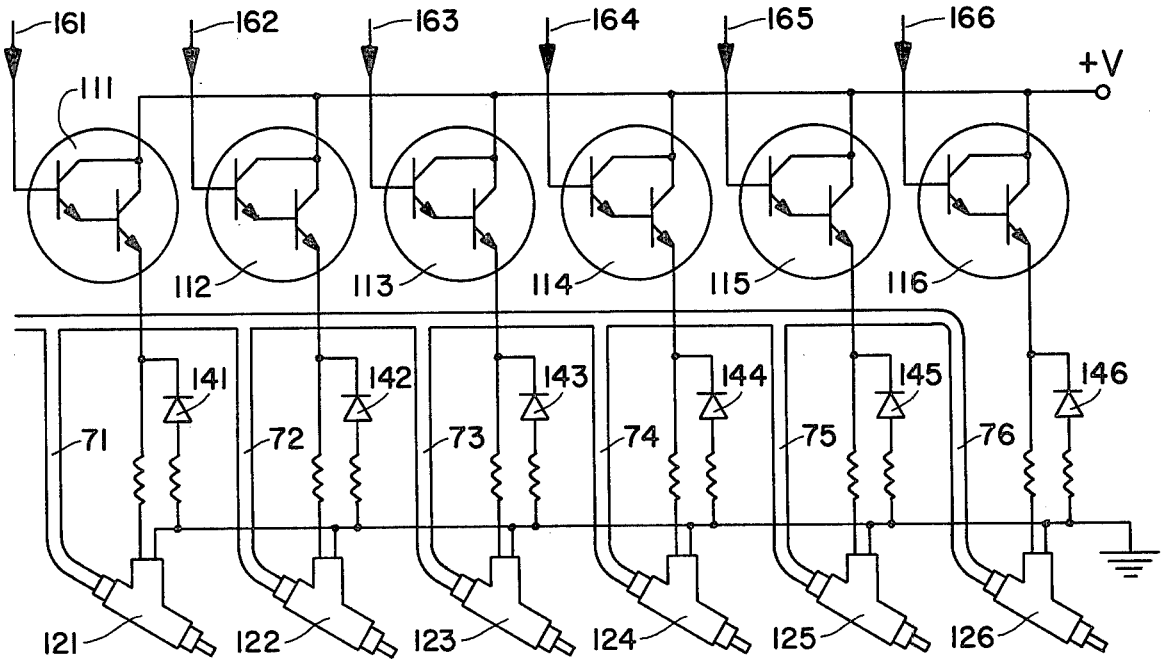
FIG. 3 shows the power amplifiers and fuel injector valves.

Referring to FIG. 3, Darlington transistors 111–116 have their input bases connected to leads 161–166 respectively. The transistor emitter leads are connected through resistors to solenoids of the six fuel injector valves 121–126 respectively. The fuel valves transmit liquid gasoline from branch fuel lines 71–76 into cylinders 1–6 respectively.

Each rationing pulse enabled by the injection inhibitor turns on one of the power transistors, depending on which one of AND gates 181–186 in the distributor has been enabled. At the end of each pulse, the power transistor cuts off, but the current through the solenoid of the injection valve tends to continue flowing. In order to prevent damage to the transistor, the currents through the solenoids are provided with a continuing path by way of diodes 141–146, shown in FIG. 3.

My engine has a water jacket with forced circulation of water to a radiator for cooling, and a conventional thermostat for inhibiting the flow of cooling water until the water jacket is hot enough for efficient engine operation. When water flowing through the radiator becomes too hot, its high temperature is sensed and a cooling fan is automatically turned on to force ambient air through the radiator. The air inlet valve opens and closes after top and bottom dead center respectively. Piston speeds are kept low to reduce pumping energy losses and loss of volumetric efficiency.

In FIGS. 3 to 15, reference numbers represent commercial components as follows:

41–46, 65 represent AND gate CD4081B,
65, 181–186 represent AND gate CD4073B,
67, 168 represents NOR gate CD4001A,
64 represents Schmitt Trigger CD4093B,
87, 187 represent buffer CD4050A,
56, 120 represent inverting buffer CD4049A,
84 represents NAND latch CD4044A,
77–78, 177–179 represent D-type flip-flop CD4013A,
90–94 represent switch CD4066A,
20 represents multivibrator CD4098B,
111–116 represent Darlington transistors MPSU45,
47, 48 represent trigger OPTO XR-CD.

The integrated circuits are marketed by RCA, the Darlington transistors by Motorola, the triggers by Allison Automotive Co.

In applications where the drive train between my engine and its load tends to develop excessive oscillation at particular engine speeds, my vibration control can be used to reduce this oscillation.

OTHER EMBODIMENTS

When a high power engine is operated at high speeds, the crankshaft tends to turn through an angle greater than 120 degrees during the time that a single fuel injector valve is open. Therefore, the second embodiment of my invention uses a dual fuel injection system which allows each cylinder to receive fuel injection during a crankshaft rotation angle as large as 240 degrees.

Figure 19A:
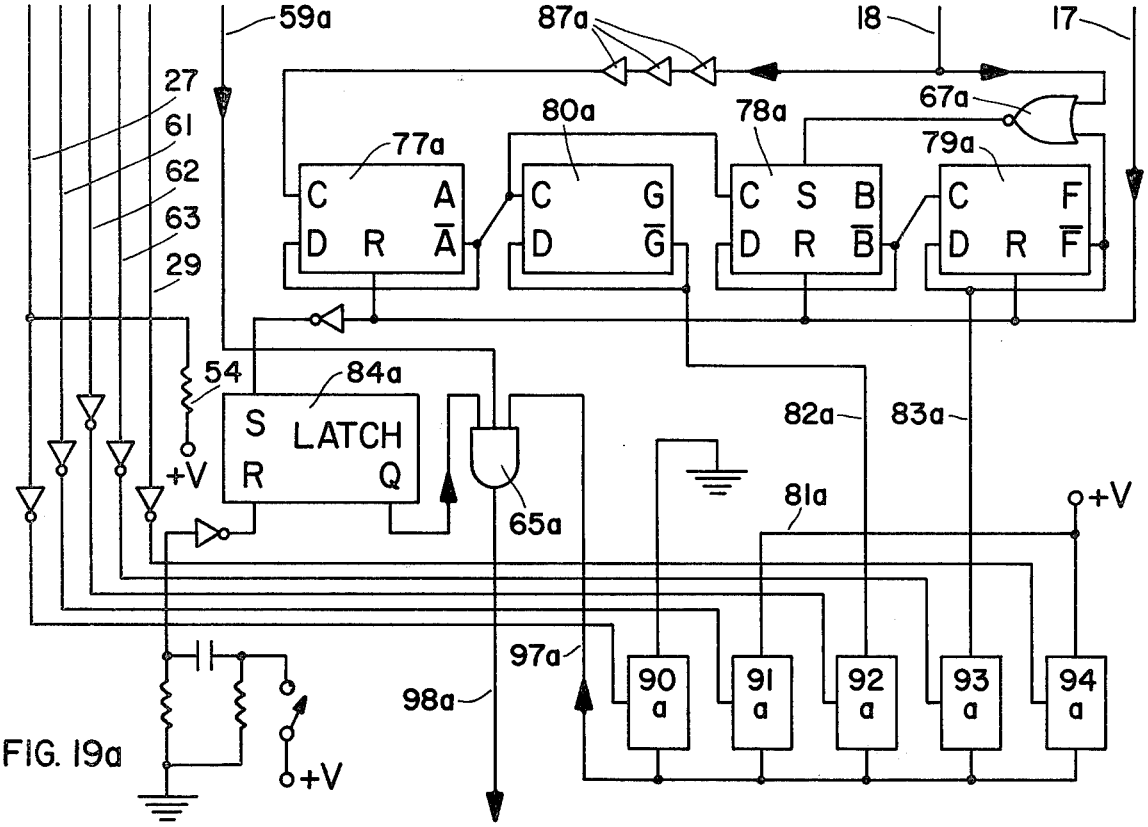
FIG. 19 diagrams the fuel injection inhibitor for a second embodiment of my invention.
Figure 19B:
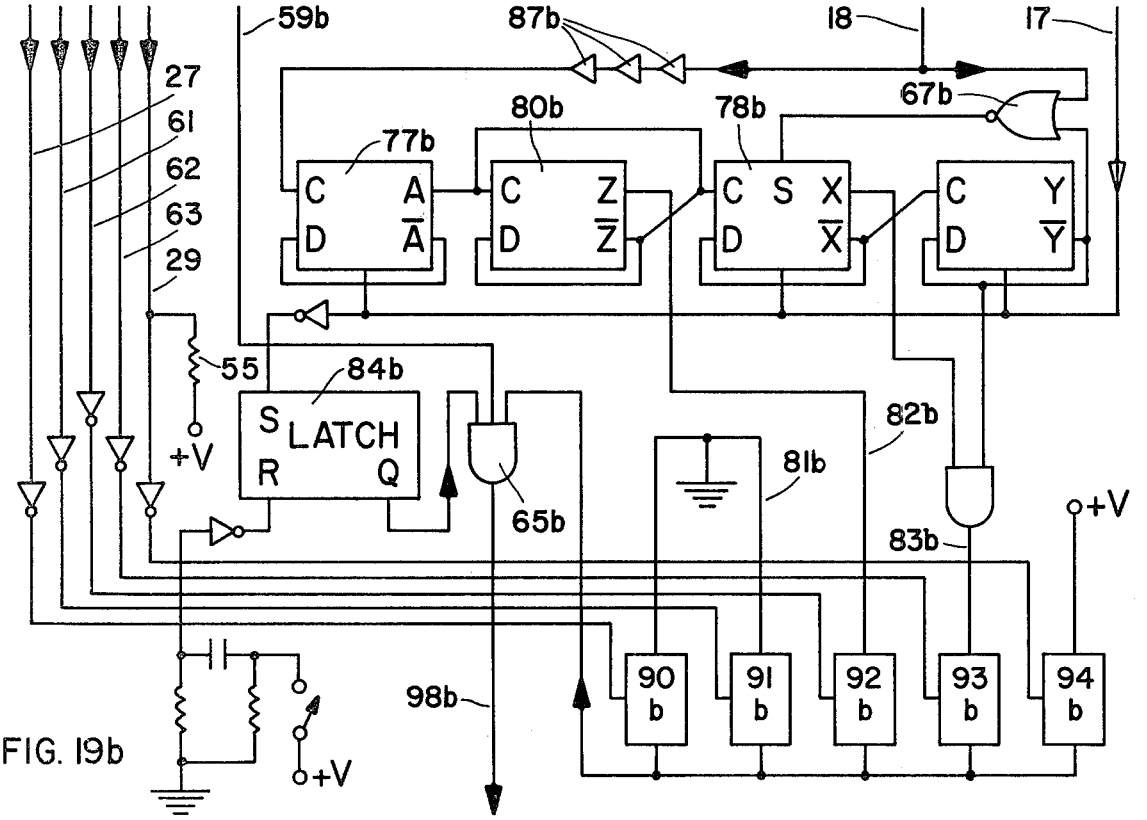
Figure 22:
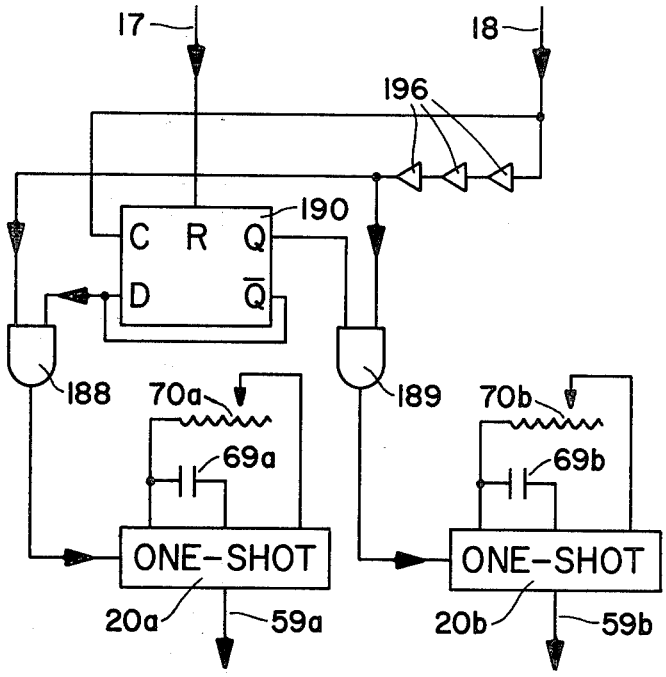
FIG. 22 diagrams the fuel rationing pulser for the second embodiment.
Figure 23:
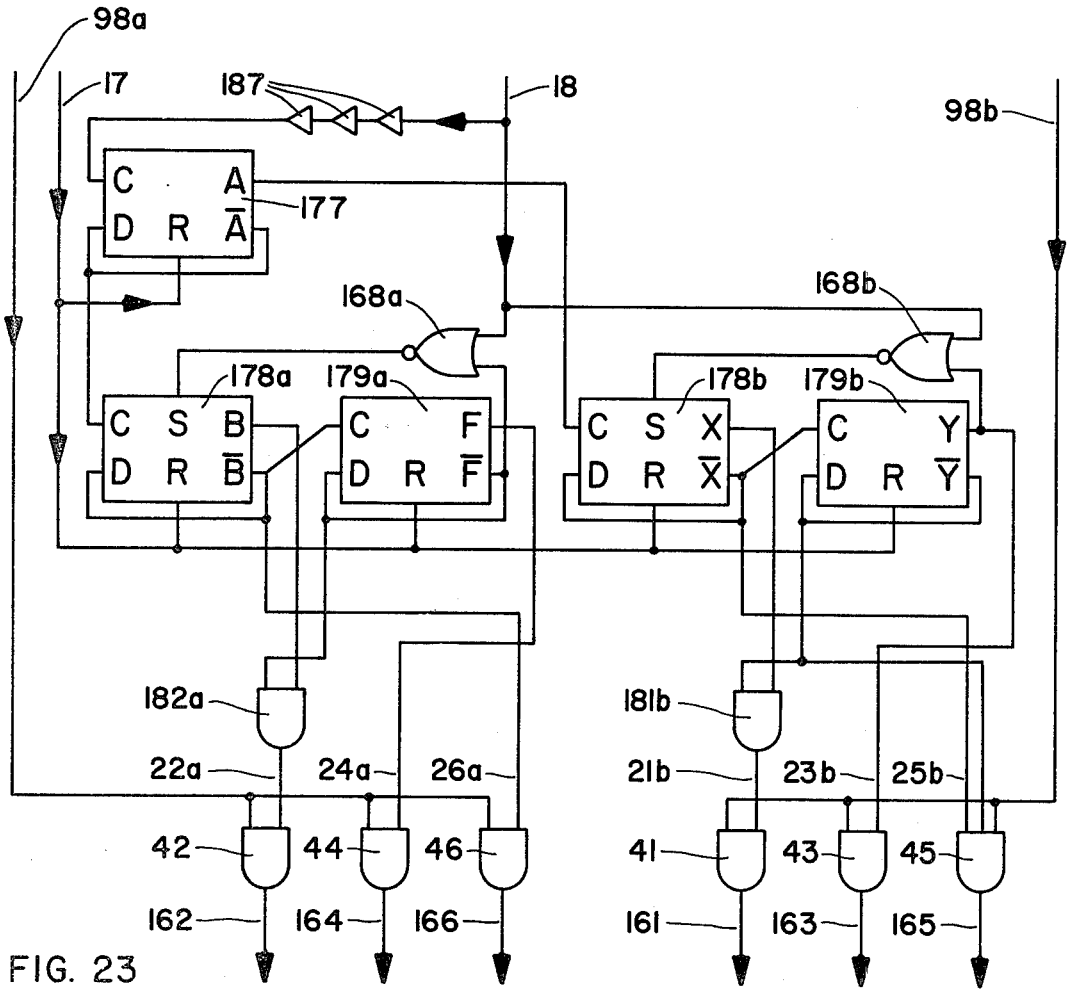
FIG. 23 shows the fuel injection distributor for the second embodiment.

The block diagram of FIG. 4 applies also to my second embodiment. The electrical units for the second embodiment are the same as those used in the preferred embodiment, except for the FUEL RATIONING PULSER, the INJECTION INHIBITOR and the INJECTION DISTRIBUTOR. In this apparatus, the FUEL RATIONING PULSER contains two fuel rationing one-shots, as shown in FIG. 22. The INJECTION INHIBITOR has two separate sets of counters, as shown in FIGS. 19*a* and 19*b*. The INJECTION DISTRIBUTOR has two divide-by-six counters as shown in FIG. 23. The remaining units shown in FIG. 4 are the same as those for the preferred embodiment. Parts in the second embodiment that are the same as those in the first embodiment are identified by the same reference numbers.

Referring to FIG. 22 for the rationing pulser, a timing pulse from trigger 48, entering on lead 18, causes flip-flop 190 to toggle. A synchronizing pulse on lead 17 ensures that the complementary output of the flip-flop is high immediately after slots 12, 14, 16 of the timing disk pass trigger 48. On the other hand, the true output of the flip-flop is high after slots 11, 13, 15 pass trigger 48. A high true output from the flip-flop enables AND gate 189, allowing one-shot 20*b* to be triggered. A high complementary output of the flip-flop enables AND gate 188, allowing one-shot 20*a* to be triggered. The trigger pulse from lead 18 to the AND gates is slightly delayed by buffers 196 in order to give the flip-flop outputs time to settle down before the trigger pulse arrives at the AND gates.

One-shot 20*a* provides the rationing pulses for cylinders 2, 4, 6, while one-shot 20*b* provides the rationing pulses for cylinders 1, 3, 5. Variable resistors 70*a*, 70*b* can be used to adjust duration of the output pulses, in order to optimize the fuel-air ratio in the cylinders. The injection inhibitor for cylinders 2, 4, 6 is shown in FIG. 19*a*, that for cylinders 1, 3, 5 is shown in FIG. 19*b*.

Referring to FIG. 19*a*, a timing pulse from trigger 48 enters on lead 18, it is delayed slightly by buffers 87*a*, then it triggers flip-flop 77*a*. As in the preferred embodiment, flip-flops 77*a*, 80*a* together constitute a divide-by-four counter, while flip-flops 77*a*, 78*a*, 79*a* constitute a divide-by-six counter. Grounding one of the leads 27, 61, 62, 63, 29 will open one of switches 90*a*–94*a* respectively. One of the pulse trains from the counters will traverse one of switches 90*a*–94*a* to bus-bar 97*a*, where it enables or inhibits AND gate 65*a*. A rationing pulse entering on lead 59*a* is either enabled or inhibited at AND gate 65*a*. The AND gate output is transmitted on lead 98*a* to the injection distributor. Relative timing of the pulse trains is shown in FIG. 20.

Figure 20:
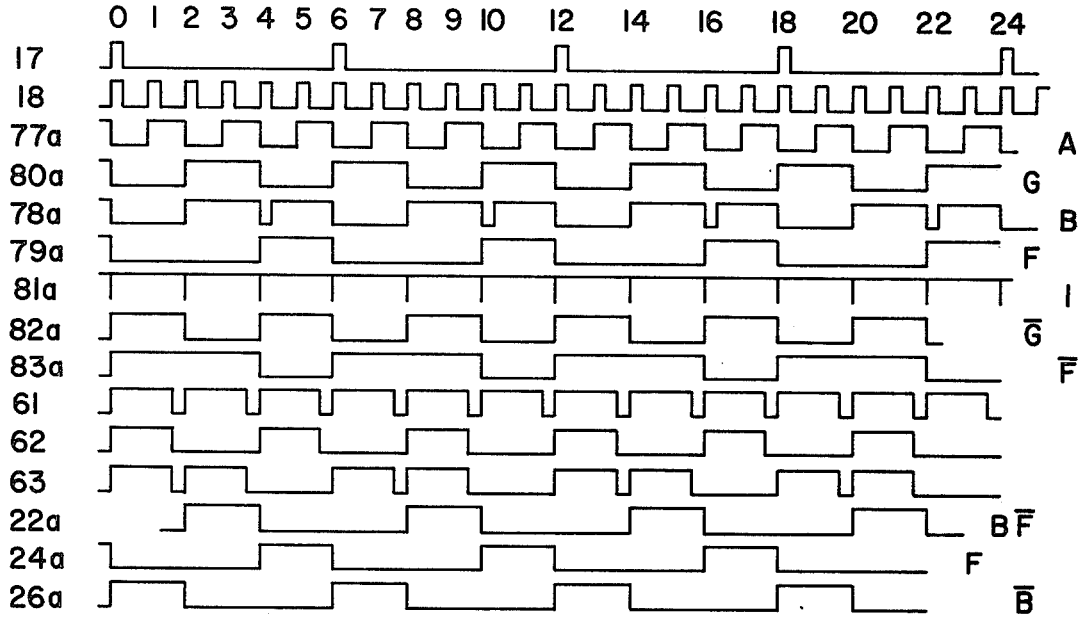
FIGS. 20, 21 show timing of enabled and inhibited fuel rations for the second embodiment.

The first six trains of pulses in FIG. 20 are identical to those shown in FIG. 10 for the first embodiment. The three trains of pulses labeled 81*a*, 82*a*, 83*a* in FIG. 20 represent the pulses on leads 81*a*–83*a* of FIG. 19*a*. The positive (enabling) pulses in these trains have the same starting times (relative to the synchronizing pulse on lead 17) as in the preferred embodiment, but the pulses last twice as long as in the preferred embodiment. In FIG. 20, the expressions at the right hand end of the lines labeled 81*a*, 82*a*, 83*a* are Boolean algebraic forms specifying the connections of leads 81*a*, 82*a*, 83*a* to the complementary outputs of the counters in FIG. 19*a*, and to the positive terminal of the power supply. The trains of positive (enabled) rationing pulses labeled 61, 62, 63 in FIG. 20 can last twice as long as those in the preferred embodiment without interfering with other pulses from the same rationing one-shot. The injection inhibitor for the other three cylinders is shown in FIG. 19*b*.

Referring to FIG. 19*b*, timing pulses entering on lead 18 are delayed slightly by buffers 87*b*, then counted on a divide-by-four counter comprising flip-flops 77*b*, 80*b* and a divide-by-six counter comprising flip-flops 77*b*, 78*b*, 79*b*. The difference from FIG. 19*a* is that flip-flops 80*b* and 78*b* are driven from the true output A of flip-flop 77*b*, rather than its complementary output $\overline{A}$. Relative timing of the pulse trains is shown in FIG. 21.

Figure 21:
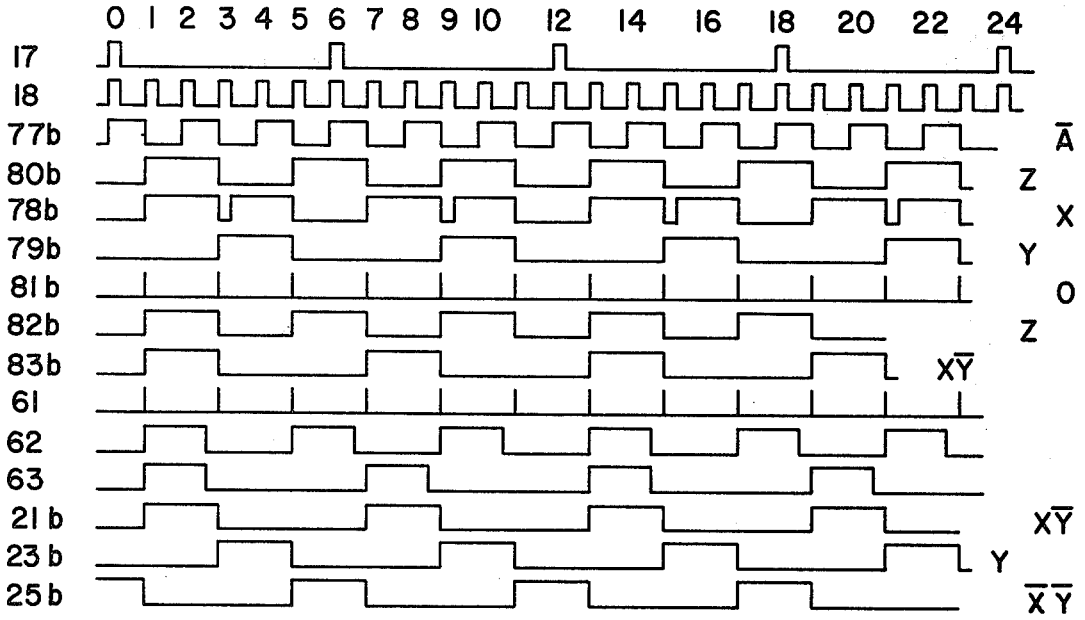

Referring to FIG. 21, the first two lines, labeled 17, 18, are the same as in FIGS. 10 and 20. Other lines are shifted one count earlier or later, as compared to the same line in FIG. 20.

The three trains of pulses labeled 81*b*, 82*b*, 83*b* in FIG. 21 represent the pulses on leads 81*b*, 82*b*, 83*b* of FIG. 19*b*. The expressions at the right hand end of these three rows in FIG. 21 are Boolean algebraic forms specifying the connections to the true and complementary outputs of the counters in FIG. 19*b*, and to ground.

The injection distributor for all six cylinders is shown in FIG. 23 Referring to FIG. 23, a pulse from trigger 48 enters on lead 18, is delayed slightly by buffers 187, and then triggers flip-flop 177. Flip-flops 177, 178*a*, 179*a* constitute divide-by-six counter "a", while flip-flops 177, 178*b*, 179*b* constitute divide-by-six counter "b". Counters a and b are both synchronized by means of a positive pulse from trigger 47, entering on lead 17. The true outputs of flip-flops 178*a*, 179*a*, 178*b*, 179*b* are labeled B, F, X, Y respectively. The difference between counters a and b is that flip-flop 178*a* is driven from the *complementary* output $\overline{A}$ of flip-flop 177, while flip-flop 178*b* is driven from the *true* output A of flip-flop 177.

Output leads 22*a*, 24*a*, 26*a* distribute fuel rations to cylinders 2, 4, 6. These leads provide inputs to AND gates 42, 44, 46; lead 98*a* from the injection inhibitor provides the other input to each of these AND gates. Outputs from the AND gates go to the power amplifiers and fuel injector valves, shown in FIG. 3.

Referring to FIG. 23, counter b output leads 21*b*, 23*b*, 25*b* distribute fuel rations to cylinders 1, 3, 5. These leads provide inputs to AND gates 41, 43, 45; lead 98*b* from the injection inhibitor provides the other input to these AND gates. Outputs from the AND gates go to the power amplifiers and fuel injector valves.

The trains of pulses on leads 22*a*, 24*a* and 26*a* are shown as the last three lines of FIG. 20. The Boolean algebraic forms at the right hand end of these lines in FIG. 20 specify the connections of the leads to the counter outputs, shown in FIG. 23. The trains of pulses on leads 21*b*, 23*b*, 25*b* are shown as the last three lines of FIG. 21. The Boolean algebraic forms at the right hand end of these lines in FIG. 21 specify the connections of the leads to the counter outputs, shown in FIG. 23.

In this second embodiment of my invention, the time allowed for fuel injection into the cylinders can be as long as the air inlet valve is open. At very high engine speeds, when the operating cylinders are enabled 100 percent of the time, the fuel injection valves can even be left open for a short time after their air inlet valves close. In this case, the fuel ration used in a particular cylinder cycle is the sum of the fuel injected during that cycle while the air inlet valve is open, plus the fuel injected during the preceding cycle of the same cylinder after the air inlet valve has closed.

In this second embodiment, which uses only two fuel rationing one-shots, the maximum duration of a fuel rationing pulse is 240 degrees of crankshaft travel. The vibration characteristics of the second embodiment, as illustrated in FIGS. 11–14, are identical to the vibration characteristics of the preferred embodiment. The distributions of enabled and inhibited cylinder cycles over the six cylinders are the same as those for the preferred embodiment, illustrated in FIGS. 16, 17, 18.

The previously described methods of controlling engine vibration can be applied to engines with any number of combustion chambers. Moreover, the appropriate pattern of successive enablement and inhibition of fuel rations can be selected automatically instead of manually. The third embodiment of my invention is a four cylinder engine with an automatic vibration control.

Figure 24:
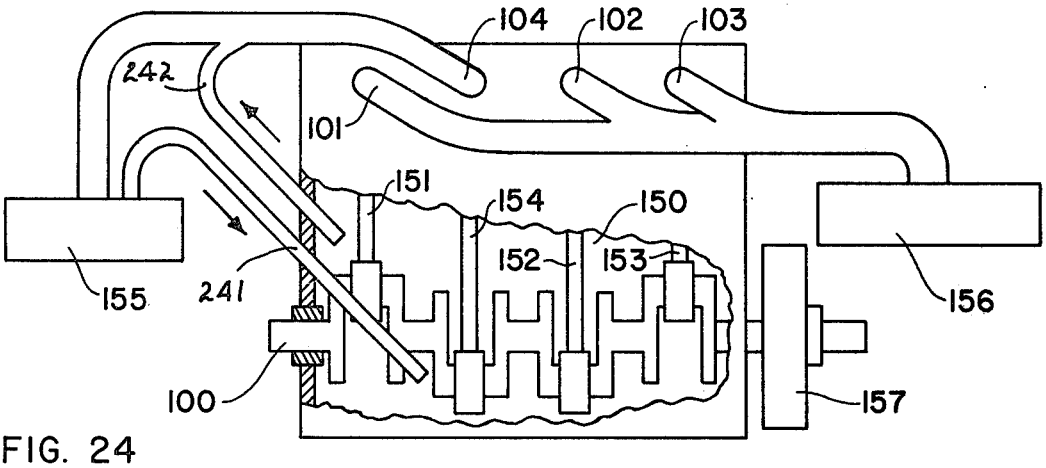
FIG. 24 shows a four cylinder engine for third and fourth embodiments.

FIG. 24 is a partly sectional view of the four cylinder engine showing crankshaft 100, crankcase 150, and connecting rods 151–154 coupling power from pistons in the four cylinders to the crankshaft. Cylinders 1, 2, 3 receive their air through air inlet ducts 101, 102, 103 respectively, the air being cleaned by a common air cleaner 156. Cylinder No. 4 receives air through air inlet duct 104, cleaned by air cleaner 155.

Small amounts of the compressed air-fuel mixture leak past the four pistons into the common crankcase. If the crankcase is not vented, the oil is diluted and contaminated. If the crankcase is vented directly to the atmosphere, the blowby gases will pollute the atmosphere. It is common practice, therefore, to return the gases from the crankcase to all of the cylinders for reburning. This method of reburning the blowby gases is defeated if the primary fuel rations to the cylinders are inhibited part of the time, for the blowby gases will then be simply pumped through the cylinders into the atmosphere without reburning. It is for this reason that my third embodiment has a special cylinder (No. 4) selected to reburn the blowby gases, and this special cylinder is exempted from fuel ration inhibition.

Figure 25:
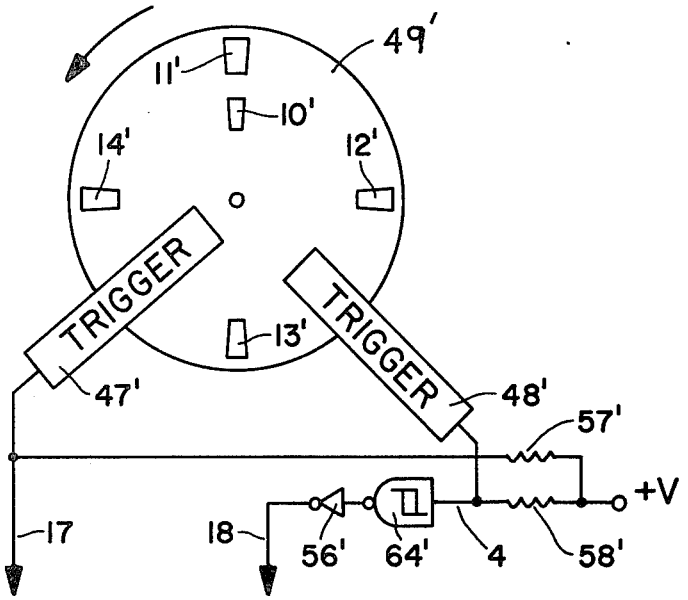
FIG. 25 shows the engine timing pulse generator for the four cylinder engine.

The block diagram of FIG. 4 is applicable to the third embodiment. The TORQUE CONTROL is the same as that in the preferred embodiment. The four fuel injectors and their drivers are the same as for the first four cylinders of the preferred embodiment. The other units will now be described. The ENGINE TIMING PULSE GENERATOR is shown in FIG. 25. It is the same as that for the preferred embodiment except that the timing disk 49′ has four slots 11′–14′ spaced 90 degrees from each other. Slot 10′ is aligned with slot 11′, but is closer to the center of timing disk 49′. Trigger 47′ is spaced 93 degrees ahead of trigger 48′ so that trigger 47′ senses slot 10′ slightly before trigger 48′ senses slot 14′. The automatic VIBRATION CONTROL is diagrammed in FIG. 27.

Figure 27:
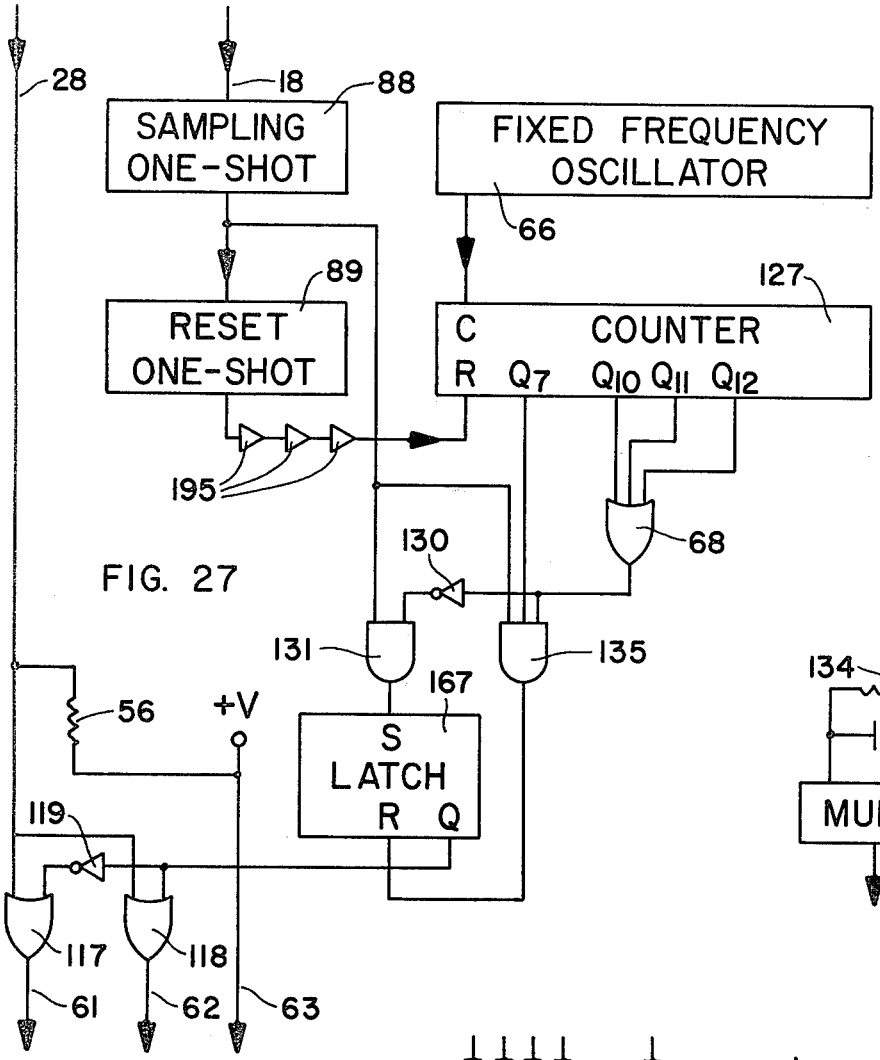
FIG. 27 shows the automatic vibration control for the third embodiment.
Figure 28:
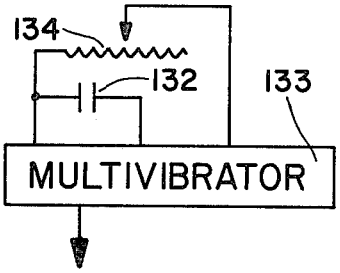
FIG. 28 shows an oscillator for the automatic vibration control.

Referring to FIG. 27, the engine speed is measured by timing the intervals between the pulses entering on lead 18 from the engine timing pulse generator. The interval is timed by counting pulses from oscillator 66. Oscillator 66, shown in FIG. 28, has an astable multivibrator 133, a resistor 134 and a capacitor 132. The capacity is 500 pf, the resistance is adjusted to about 30 kilohms to give an oscillator period of 65 microseconds.

Referring to FIG. 27, binary counter 127 has its tenth, eleventh and twelth stage outputs connected to OR gate 68. A count of less than 512 gives a negative output to OR gate 68 and a positive output to enable AND gate 131. A timing pulse entering on lead 18 triggers the sampling one-shot 88, which may cause latch 167 to be set or reset, depending on whether AND gate 131 or AND gate 135 is enabled by the counter. When the latch is set, a low steady output to the INJECTION INHIBITOR is transmitted on output lead 61; when the latch is reset, a low steady output to the INJECTION INHIBITOR is transmitted on output lead 62. These low signals are enabled at OR gates 117 and 118 when lead 28 from the TORQUE CONTROL has been grounded. The trailing edge of the sampling pulse triggers reset one-shot 89.

A count smaller than 512, corresponding to an engine speed above 900 RPM, thus provides a low signal on lead 61; a count greater than 576, corresponding to an engine speed below 800 RPM, provides a low signal on lead 62. At intermediate speeds the low output signal remains unchanged, where it has been. Output lead 63 is kept positive at all times, so that inhibition pattern no. 3 is not utilized in this third embodiment.

Figure 38:
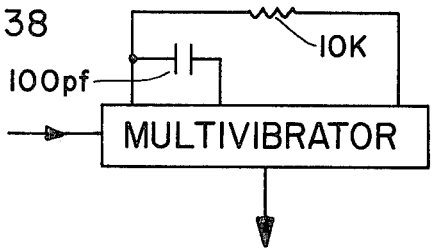
FIG. 38 show external timing elements for one-shots 88, 89, and 202.

Counter 127 is reset by a positive pulse from one-shot 89. One-shots 88 and 89 are each provided with an external resistor and capacitor, as shown in FIG. 38.

Figure 26:
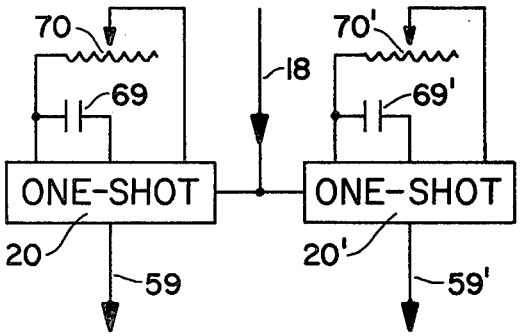
FIG. 26 shows the fuel rationing pulser for the four cylinder engine.

The RATIONING PULSER, shown in FIG. 26, is the same as that for the preferred embodiment except that a separately adjustable one-shot 20' is provided for the special cylinder. This transmits its rationing pulse on lead 59'. The INJECTION INHIBITOR is shown in FIG. 29.

Figure 29:
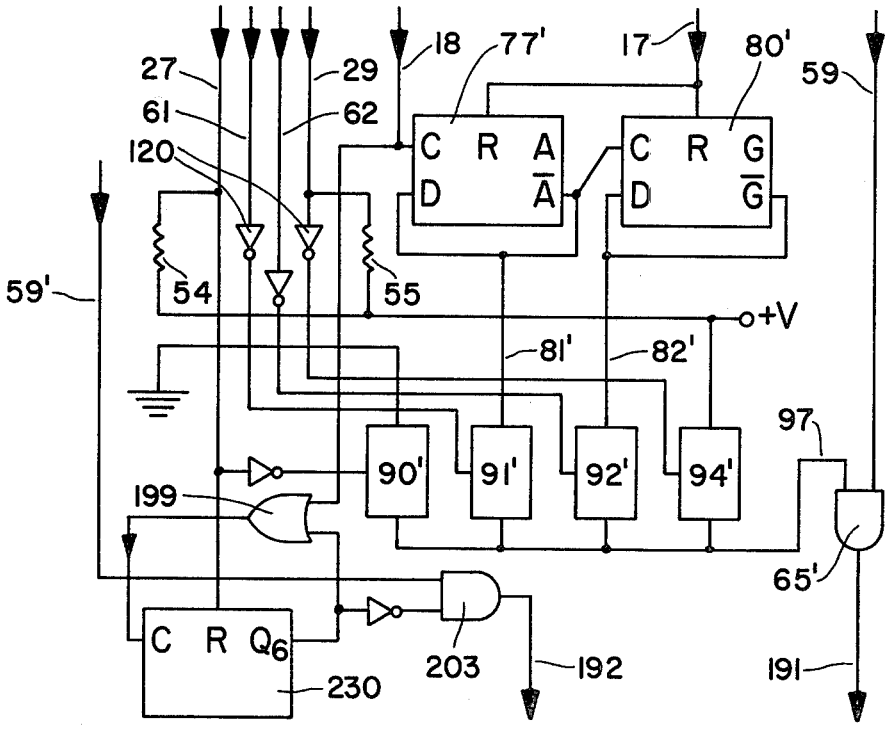
FIG. 29 shows the injection inhibitor for the third embodiment.

Referring to FIG. 29, flip-flops 77', 80' together constitute a divide-by-four counter which counts timing pulses entering on lead 18. The counter is reset to zero by an engine synchronizing pulse entering on lead 17. The complementary outputs of flip-flops 77', 80' are transmitted on leads 81', 82' through electronic switches 91', 92' respectively. These switches can be opened by steady low signals entering on leads 61, 62 from the VIBRATION CONTROL. The output from one of switches 90', 91', 92', 94' is transmitted on busbar 97 to an input of AND gate 65'.

Rationing pulses entering on lead 59 from the RATIONING PULSER are either enabled or inhibited at AND gate 65', the output of the AND gate being transmitted on lead 191 to the INJECTION DISTRIBUTOR and the INJECTION VALVES.

Timing of the two patterns of successive enablement and inhibition is shown in FIG. 30. In FIG. 30, the first four trains of pulses are the same as shown in FIG. 10 for the preferred embodiment. The next four trains of pulses labeled 81, 82, 61, 62 are the same as the correspondingly labeled trains of pulses in FIG. 10.

My four cylinder engine has a natural rocking frequency of about 10 cycles per second. The time relationships of the enabled fuel injections to the natural engine rocking period are the same as shown on FIGS. 11, 12, and 14 for the preferred embodiment.

When the torque control switch is set to the zero torque position, fuel rations to the three ordinary cylinders are immediately cut off. At this instant, there will be in the crankcase an accumulation of blowby gases from all four cylinders. If fuel rations for the special cylinder no. 4 are stopped in the same instant, then the accumulated blowby gases will be pumped through the special cylinder into the atmosphere. In order to reduce this pollution of the atmosphere, a delay is introduced into the disabling signal for the special cylinder, in order to give it a change to reburn most of the accumulated blowby gases.

Thus when lead 27 is first grounded, its only effect is to allow counter 230 to start counting the timing pulses entering on lead 18. When the count reaches 32, the true output of the sicth binary stage goes high. This disables OR gate 199 and AND gate 203, thereby stopping the counter and inhibiting the transmission of rationing pulses from input lead 59' to output lead 192. The delay in inhibition gives special cylinder no. 4 time to reburn most of the blowby gases before being disabled. The INJECTION DISTRIBUTOR for my four cylinder engine is diagramed in FIG. 31.

Referring to FIG. 31, flip-flops 197, 198 together constitute a divide-by-four counter which counts the timing pulses entering on lead 18. A synchronizing pulse entering on lead 17 ensures that the counter is reset to zero immediately after slot 14' on the engine timing disk passes trigger 48'. The rationing pulses entering on leads 191, 192 provide inputs to AND gates 41'–44'. The decoded counter outputs on leads 21'–24' enable the AND gates in succession, distributing the rationing pulse to the injection valve in the proper cylinder. Timing of the pulses on leads 21'–24' is shown in the last four lines of FIG. 30. Distribution of the enabled rations among the four cylinders is shown in FIGS. 32, 33.

Referring to FIGS. 32, 33, air induction intervals in which the fuel ration has been inhibited are represented by blank rectangles. Intervals in which the fuel ration has been enabled are represented by rectangles with a black insert. Induction intervals for cylinders 1, 2, 3, 4 are shown on different levels as labeled. For enablement and inhibition pattern no. 1, shown in FIG. 32, enablement is confined to the cycles of cylinders no. 2 and no. 4. For enablement and inhibition pattern no. 2, shown in FIG. 33, enablement is confined to the cycles of cylinders no. 1 and no. 4. Since cylinder no. 4 is always enabled in either state of the vibration control, this special cylinder is selected to receive the blowby gases from all four cylinders, as illustrated in FIG. 24.

While this third embodiment of my invention has the advantage of reserving a special cylinder to reburn the blowby gases, it has the disadvantage that the three ordinary cylinders do not participate equally in the inhibited cycles. Thus in pattern no. 1, cylinders 1 and 3 are steadily inhibited; in pattern no. 2, cylinders 2 and 3 are steadily inhibited. Cylinder no. 3 never receives a fuel ration in either pattern. The arrangement produces unequal heating and wear; moreover, excess oil tends to work its way into the steadily inhibited cylinders. This disadvantage of the third embodiment is corrected in the fourth embodiment of my invention.

In the previous embodiments, fractional inhibition of engine torque can only be zero or one half, so that any intermediate engine torques must be obtained by partial throttling of the air intake. Throttling is an irreversible process which results in serious power loss, even in those cylinder cycles which have inhibited fuel rations. In my fourth embodiment, throttling of the air intake is eliminated by means of a torque control having four fractional inhibition states, in addition to the zero inhibition and full inhibition states. Three of the partial inhibition states of the torque control are each associated with two states of a vibration control. The engine has a special cylinder for reburning the blowby gases and three ordinary cylinders, as shown in FIG. 24.

The block diagram of FIG. 4 is applicable to the fourth embodiment. The ENGINE TIMING PULSE GENERATOR, FUEL RATIONING PULSER, INJECTION DISTRIBUTOR and FUEL INJECTION VALVES are the same as in the third embodiment.

The TORQUE CONTROL, shown in FIG. 34, has a six-position rotary switch 200 with its rotor held permanently at the upper power supply potential. The six output leads 211–216 are normally pulled toward ground potential by means of pull down resistors 217.

The VIBRATION CONTROL, shown in FIG. 35, has a two position rotary switch 220 with its rotor connected to output lead 210. The switch allows lead 210 to be held at either ground potential or the upper power supply potential. The INJECTION INHIBITOR is shown in FIG. 36.

Referring to FIG. 36, timing pulses entering on lead 18 trigger one-sot 202, which has a short positive output pulse of sufficient duration to be counted by counters 230 and 240. One pulse out of four is inhibited at AND gate 201 by a much longer timing pulse entering on lead 17. The other three pulses out of four are counted on divide-by-eight counter 240, having true outputs labeled X, Y, Z. One of the gated outputs from this counter, on one of leads 204–206, is transmitted through one of the electronic switches 84–86 to busbar 97. Rationing pulses for the three ordinary cylinders enter on lead 59 and are enabled or inhibited at AND gate 65', under control of counter 240.

As in the third embodiment, rations for special cylinder no. 4 are continued for a short time after rations for the three ordinary cylinders have been completely disabled. This gives the special cylinder a change to reburn most of the blowby gases which have accumulated in the crankcase. In this fourth embodiment, activation of either lead 211 or lead 212 will allow counter 230 to count, but only activation of lead 211 will actually disable the special cylinder at AND gate 203, and reduce the engine output torque to zero. The timing one-shot 202 is provided with an external resistor and capacitor, as shown in FIG. 38.

The patterns of enablement and inhibition for the three ordinary cylinders are shown in FIG. 37 for six different states of the torque control and for the two different states of the vibration control. The first column of FIG. 37 identifies the torque control state. The second column gives the engine output torque as a fraction of the full output torque produced when all cylinder cycles are enabled. For torque control state no. 2, the fractional torque is due entirely to special cylinder no. 4, since the three ordinary cylinders are completely disabled.

The third column of FIG. 37 gives the state of the vibration control for each of three different states of the torque control. In this column, "0" represents ground potential on the output lead 210 of the vibration control, and "1" represents the upper power supply potential on this output lead. The fourth column of FIG. 37 shows a Boolean algebraic form specifying the potential of one of the counter output leads 204–206 of FIG. 36 in terms of the potentials of the three true outputs X, Y, Z of counter 240. The last eight columns of FIG. 37 give the potential of busbar 97 of FIG. 36 for each count of the divide-by-eight counter 240. In these columns again, "0" represents the low potential and "1" represents the high potential. For the central seven rows of FIG. 37, distribution of enabled and inhibited cycles among the cylinders is shown in FIGS. 39–45 respectively.

Figure 39:
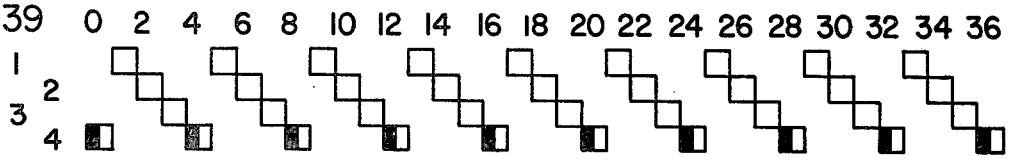
FIGS. 39–46 show distribution of enabled and inhibited cycles among the cylinders for the fourth embodiment.

In FIGS. 39 to 45, cycles for cylinders 1, 2, 3, 4 are shown on different levels, as labeled. Each blank square represents an air induction interval in which the fuel ration is inhibited; each square with a black insert represents an induction interval in which the fuel ration is enabled. In FIG. 39, only the special cylinder no. 4 has enabled cycles. These give an average engine torque output equal to one quarter of full torque.

Figure 40:
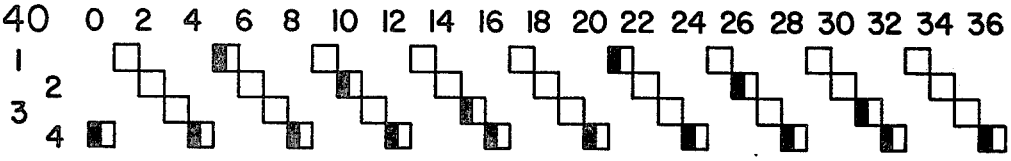
Figure 41:
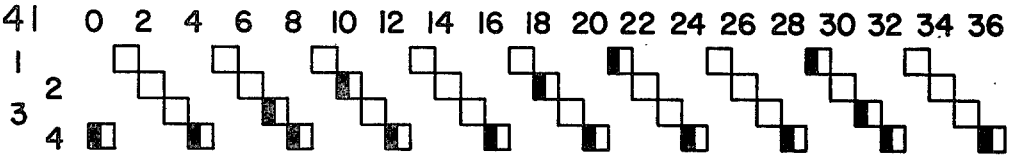

FIGS. 40 and 41 both correspond to a fractional torque output of 0.44, but to two different states of the vibration control. In FIG. 40, the pattern of successive enablement and inhibition repeats itself after sixteen piston strokes of a single cylinder, or eight crankshaft revolutions. In FIG. 41, the pattern repeats itself after thirty two piston strokes of a single cylinder, or sixteen crankshaft revolutions.

Figure 42:
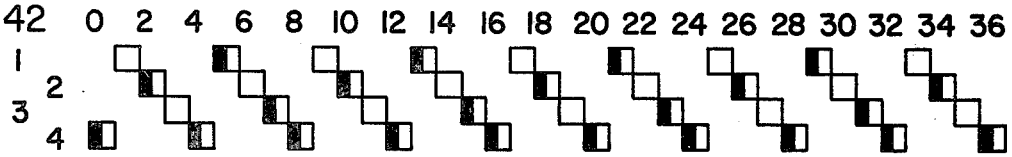
Figure 43:
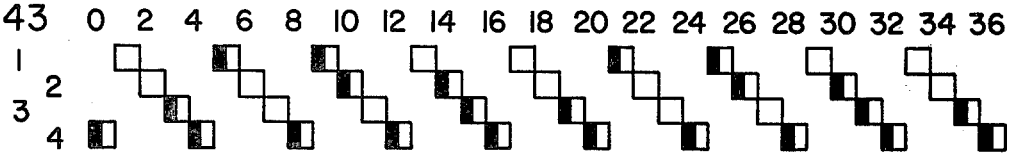

FIGS. 42 and 43 both correspond to a fractional torque output of 0.625, but to different states of the vibration control. In FIG. 42 the pattern of enablement and inhibition repeats itself after four crankshaft revolutions. In FIG. 43 the pattern repeats itself after eight crankshaft revolutions.

Figure 44:
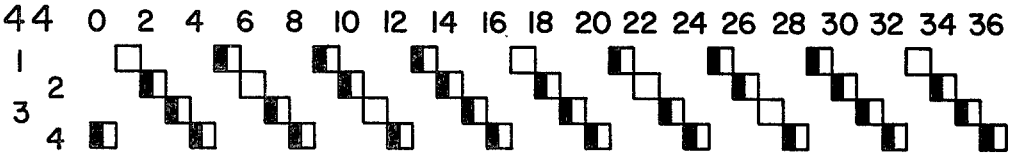
Figure 45:
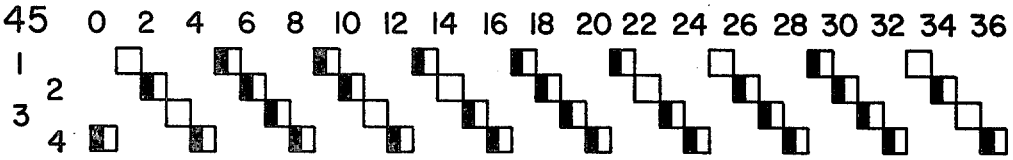

FIGS. 44 and 45 both correspond to a fractional torque output of 0.81, but to different states of the vibration control. In FIG. 44 the pattern repeats itself after eight crankshaft revolutions; in FIG. 45 the pattern repeats itself after sixteen crankshaft revolutions.

In FIGS. 19 to 38, reference numbers represent commercial components as follows:

131, 188, 189, 181*b*, 182*a*, 201, 203 represent AND gate CD4081B, 135 represents AND gate CD4073B, 117, 118 represent OR gate CD4071B, 6B represents OR gate CD4075B, 119, 130 represent inverter CD4049A, 195, 196 represent buffer CD4050A, 190, 197, 198 represent flip-flop CD4013A, 88, 89, 133, 202 represent multivibrator CD4047A, 167 represents NOR LATCH CD4043A, 230, 240 represent Counter CD4024A, 127 represents Counter CD4040A. These integrated circuits are marketed by RCA.

In describing the repetitive patterns of enablement and inhibition in FIGS. 39–45, the starting and end points of the pattern are arbitrary. Thus the repetitive pattern of enablement and inhibition shown in FIG. 45 can be equally well described by FIG. 46, in which the same pattern which was shown in FIG. 45 appears to be shifted four counts to the left.

Figure 46:
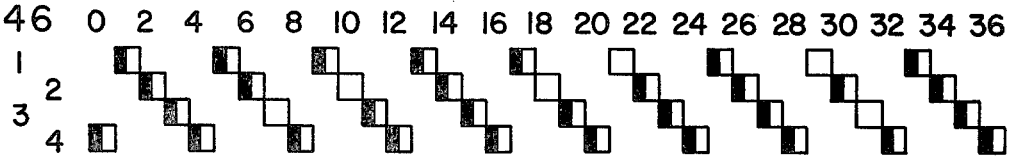

Some synchronization between crankshaft rotation and fuel injection is essential when the engine is operating at partial output torque. Therefore, as shown in FIG. 31, the *distributor* counter is reset to zero by a synchronizing pulse entering on lead 17 from the ENGINE TIMING PULSE GENERATOR. On the other hand, as seen in FIG. 36, the *inhibitor* counter 240 is not reset to zero by a synchronizing pulse, so that the counts shown in FIGS. 41–46 are completely arbitrary. Synchronization is unnecessary because the vibratory characteristics of the different patterns of enablement and inhibition depend on the time intervals between successive explosions, primarily. FIGS. 45 and 46 are considered to be two different pictures of the same repetitive pattern of enabled and inhibited cylinder cycles.

I claim:

1. An improved vibration control for an internal combustion engine having one or more combustion chambers, each combustion chamber being partially bounded by its movable piston, the one or more pistons being mechanically coupled to a common power output shaft, the engine having means for executing a series of combustion chamber cycles, the engine having means for providing a ration of fuel in each of its combustion chamber cycles, first control means overriding the fuel providing means, which can enable or inhibit the fuel ration in a first repetitive pattern of successive enabled and inhibited combustion chamber cycles, the period of repetition containing D combustion chamber cycles, where D is an integer greater than one and smaller than a hundred, the number of enabled combustion chamber cycles within each period being N, the fraction of enabled cycles being the quotient of N divided by D, the improvement comprising:

second control means overriding the fuel providing means, which can enable or inhibit the fuel ration in a second repetitive pattern of successive enabled and inhibited combustion chamber cycles, the second repetitive pattern being different from the first repetitive pattern, but having the same fraction of enabled cycles as the first repetitive pattern, vibration control means for switching from the first pattern to the second pattern and from the second pattern to the first pattern while the engine is running, in order to reduce transmission of mechanical vibration from the engine to its environment.

2. A vibration control as recited in claim 1, wherein means are provided for measuring the engine speed, and in which said means for switching between the first and second patterns can operate automatically in at least partial dependence on the engine speed.

3. An improved vibration control for an internal combustion engine, the engine having a plurality of at least four combustion chambers, each combustion chamber being partially bounded by its movable piston, the plurality of pistons being mechanically coupled to a common power output shaft, each combustion chamber having means for executing a series of combustion chamber cycles, each combustion chamber having means to provide a ration of fuel during each of its cycles; the engine having first control means, overriding the fuel providing means, for steadily enabling the fuel ration to a first set of M combustion chambers while steadily inhibiting the fuel ration from the remainder of the combustion chambers, M being an integer in the range two to ten inclusive, the improvement comprising:

second control means overriding the fuel providing means, for steadily enabling the fuel ration to a second set of the combustion chambers while steadily inhibiting the fuel ration from the remainder of the combustion chambers, the second set having the same integral number of the combustion chambers as the first set, the second set including at least one of the combustion chambers that is not included in the first set, vibration control means for switching enablement of fuel rations from the first set of combustion chambers to the second set of combustion chambers and from the second set to the first set while the engine is running, in order to reduce transmission of mechanical vibration from the engine to its environment.

4. A vibration control as recited in claim 3, wherein means are provided for measuring the engine speed, and in which said means for switching enablement of fuel rations between the first and second sets can operate automatically in at least partial dependence on the engine speed.

* * * * *